US005380638A

United States Patent [19]

Takizawa et al.

[11] Patent Number: 5,380,638

[45] Date of Patent: Jan. 10, 1995

[54] CYAN DYE-FORMING COUPLER AND A SILVER HALIDE COLOR PHOTOGRAPHIC MATERIAL CONTAINING THE SAME

[75] Inventors: Hiroo Takizawa; Hideotoshi Kobayashi; Hideki Naito, all of Minami-ashigara, Japan

[73] Assignee: Fuji Photo Film Co., Ltd., Kanagawa, Japan

[21] Appl. No.: 956,105

[22] Filed: Oct. 2, 1992

[30] Foreign Application Priority Data

Oct. 8, 1991 [JP] Japan ..... 3-287226

[51] Int. Cl.[6] ..... G03C 7/34

[52] U.S. Cl. ..... 430/552; 430/553

[58] Field of Search ..... 430/552, 553

[56] References Cited

U.S. PATENT DOCUMENTS

| | | | |
|---|---|---|---|
| 3,767,411 | 10/1973 | Kishimoto et al. | 430/553 |
| 4,288,532 | 9/1981 | Seoka et al. | 430/553 |
| 4,883,746 | 11/1989 | Shimada et al. | 430/553 |
| 4,960,685 | 10/1990 | Bowne | 430/553 |

FOREIGN PATENT DOCUMENTS

| | | | |
|---|---|---|---|
| 675931 | 6/1966 | Belgium | 430/553 |
| 543246 | 7/1957 | Canada | 430/553 |
| 1146368 | 3/1969 | United Kingdom | 430/553 |

*Primary Examiner*—Lee C. Wright

*Attorney, Agent, or Firm*—Birch, Stewart, Kolasch & Birch

[57] ABSTRACT

There is disclosed a cyan dye-forming coupler represented by the following formula (I) and a silver halide color photographic material containing the same: formula (I)

wherein R represents a hydrogen atom, an alkyl group having 1 to 8 carbon atoms, or an aryl group having 6 to 20 carbon atoms, Y represents a group capable of substitution onto a benzene ring, Z represents a group capable of substitution onto a naphthalene ring, X represents a hydrogen atom or a coupling-off group, m is an integer of 0 to 4, and n is an integer of 0 to 4.

8 Claims, 1 Drawing Sheet

CYAN DYE-FORMING COUPLER AND A SILVER HALIDE COLOR PHOTOGRAPHIC MATERIAL CONTAINING THE SAME

FIELD OF THE INVENTION

The present invention relates to a new cyan dye-forming coupler (hereinafter referred to as cyan coupler) and a silver halide photographic material containing the same.

BACKGROUND OF THE INVENTION

When a silver halide photographic material is exposed to light and is subjected to color development processing, a developing agent, such as an aromatic primary amine, is oxidized with the silver halide to react with dye-forming couplers to form a color image. Generally in this method, the color reproduction is often effected by the subtractive color process, wherein in order to reproduce blue, green, and red colors, yellow, magenta, and cyan color images complementary to them are formed.

As cyan color image forming couplers, phenols or naphthols are used in many cases. However, concerning the preservability of color images obtained from conventionally used phenols and naphthols, some problems remain unsolved. For instance, color images obtained from 2-acylaminophenol cyan couplers described, for example, in U.S. Pat. Nos. 2,367,531, 2,369,929, 2,423,730, and 2,801,171 are generally poor in heat fastness; color images obtained from 2,5-diacylaminophenol cyan couplers described in U.S. Pat. Nos. 2,772,162 and 2,895,826 are generally poor in light fastness; and a 1-hydroxy-2-naphthamide cyan coupler is generally unsatisfactory in both light fastness and heat (particularly heat and humidity) fastness.

Further, the cyan dyes obtained from these couplers have undesirable absorptions in the blue and green regions and therefore have a serious problem that lowers color reproduction remarkably, which is desired to be solved.

As means of solving this problem, imidazole-type cyan couplers described in EP (European Patent) Nos. 249,453A, 304,856A, 320,778A, and 354,549A, pyrazoloazole-type cyan couplers described, for example, in U.S. Pat. Nos. 4,873,183 and 4,916,051, pyrazolopyrimidine-5-one and pyrazolopyrimidine-7-one-type cyan couplers described in EP No. 304,001A, and pyrazoloquinazolone-type cyan couplers described in EP No. 329,036A and JP-A ("JP-A" means unexamined published Japanese patent application) No. 166446/1990 are mentioned. However, these couplers cannot solve the above problems fundamentally because, for example, these couplers are poor in the coupling reactivity with the oxidized product of a developing agent, they are poor in the spectral absorption characteristics of the obtained cyan color image (for example, the maximum absorption wavelength is too short, there is a certain level or over of undesirable absorption in the blue region or green region, or a satisfactorily effective absorption coefficient is not present in the long wavelength side), and they are poor in the stability of the cyan color image against heat, humidity, or light.

As another way of obtaining a cyan color image having preferable spectral absorption characteristics, a technique wherein the phenomenon of association, cohesion, or crystallization of dyes is used is mentioned. For example, an image-forming method is disclosed in U.S. Pa. No. 3,002,836 wherein a silver halide photographic material that has been exposed to light is developed with a developer containing an alkali-soluble 1-naphthol-type cyan coupler having the following specific structure:

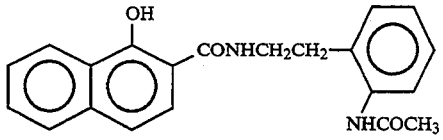

to obtain cyan development.

In this image-forming process, the produced indoaniline dye is immobilized by association, cohesion, or crystallization in the gelatin film, and it gives a cyan color image quite small in undesirable absorption in the blue and green regions and having excellent spectral absorption characteristics in view of the color reproduction. This method is applied to Kodachrome that uses the so-called coupler-in-developer-type development and gives a fast cyan color image excellent in tone. However, this method is defective in that it cannot be applied to the coupler-in-emulsion-type system, for example, for color negative films, color reversal films, and color papers which is currently mainly used.

As a technique of overcoming this defect, means is disclosed in JP-A No. 108662/1980 wherein, for a coupling-off group (a group capable of being released upon a coupling reaction of the coupler with the oxidized product of a color developing agent) in the 4-position of 1-naphthol, a coupling-off group that can render the coupler nondiffusible is selected to make the coupler immobilized in the photographic material, and also a silver halide color photographic material is disclosed in U.S. Pat. No. 4,960,685 wherein the above means is combined with a specific magenta coupler and yellow coupler. However, the cyan image obtained from such a cyan coupler has a defect that generally the tone is liable to change with the lapse of time due to heat, light, and humidity, and improvement is desired.

JP-B ("JP-B" means examined Japanese patent publication) No. 14523/1975 discloses a photographic material that contains an N-phenyl-1-hydroxy-2-naphthamide-type cyan coupler whose benzene ring is substituted by a carbamoyl group or amido group having a long-chain alkyl group with 10 or more carbon atoms. However, the tone of the cyan image obtained from these cyan couplers is also liable to change with the lapse of time.

SUMMARY OF THE INVENTION

Therefore, the first object of the present invention is to provide a cyan coupler that can form a cyan color image excellent in spectral absorption characteristics and a silver halide color photographic material containing the same.

The second object of the present invention is to provide a cyan coupler that can form a cyan color image excellent in fastness to heat, light, and humidity and a silver halide color photographic material containing the same.

Other and further objects, features, and advantages of the invention will appear more evident from the following description taken in conjunction with the accompanying drawing.

DETAILED DESCRIPTION OF THE INVENTION

Figure 1:
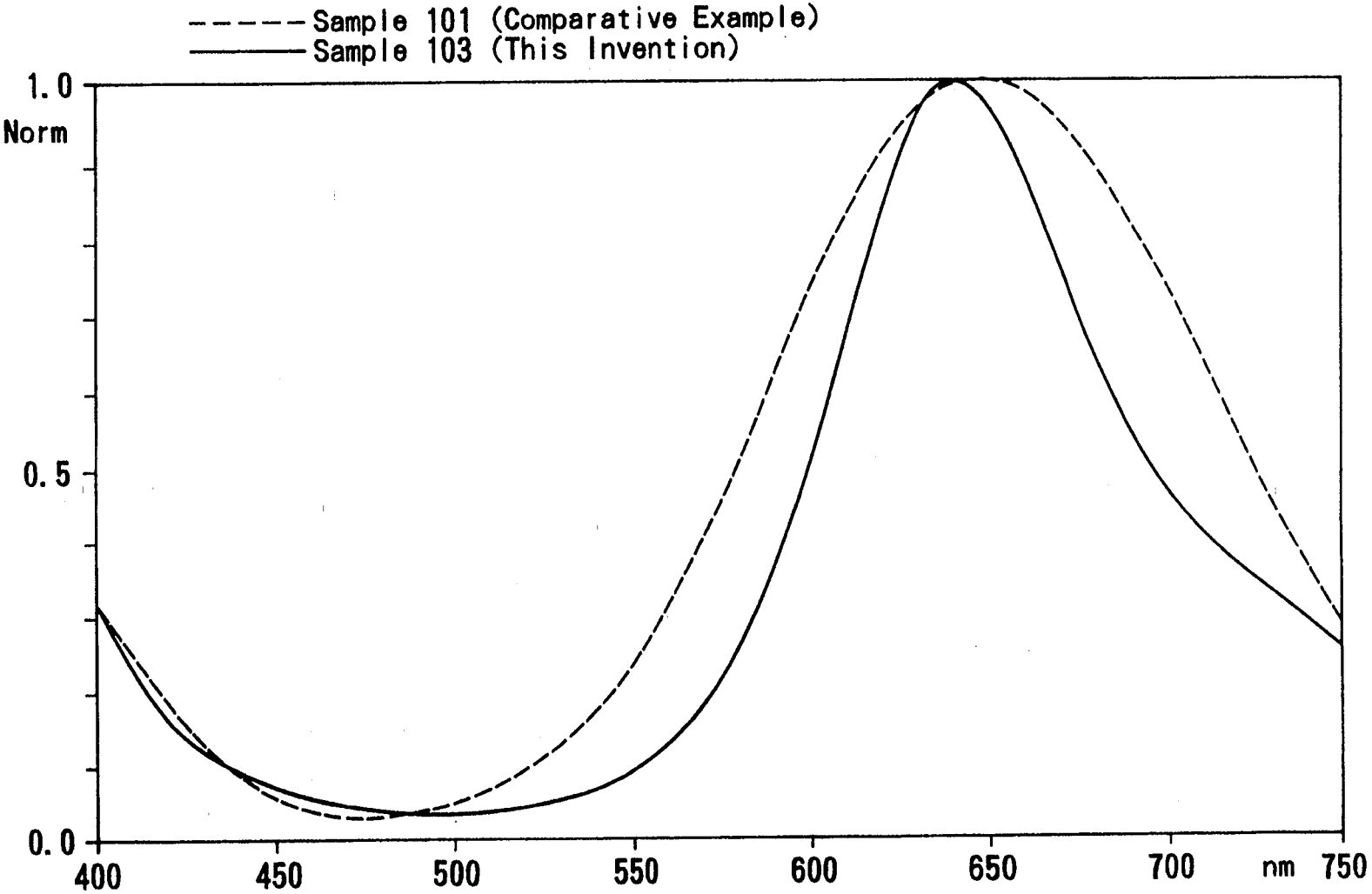
FIG. 1 shows the absorption spectra of the cyan dyes obtained from a cyan coupler of the present invention and a comparative coupler respectively.

It has been found that the above objects can be attained particularly remarkably by a cyan coupler given below under (1) and a silver halide color photographic material given below under (2).

(1) A cyan coupler represented by the following formula (I):

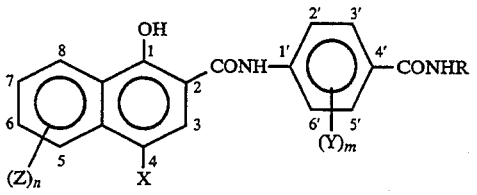

wherein R represents a hydrogen atom, an alkyl group having 1 to 8 carbon atoms, or an aryl group having 6 to 20 carbon atoms, Y represents a group capable of substitution onto a benzene ring, Z represents a group capable of substitution onto a naphthalene ring, X represents a hydrogen atom or a coupling-off group, m is an integer of 0 to 4, and n is an integer of 0 to 4.

(2) A silver halide color photographic material, which comprises at least one of cyan couplers represented by formula (I).

The present cyan coupler will be described in detail below.

Herein, where, in formula (I), a substituent is an alkyl group or one that contains an alkyl group, unless otherwise stated, the alkyl group may be a straight-chain, branched-chain, or cyclic alkyl group which may be substituted and may be unsaturated.

Where, in formula (I), a substituent is an aryl group or one that contains an aryl group, unless otherwise stated, the aryl group may be substituted and may be a monocyclic or condensed ring.

In formula (I), R represents a hydrogen atom, an alkyl group having a total carbon number (hereinafter referred to as C-number) of 1 to 8 (e.g., methyl, n-propyl, i-butyl, n-hexyl, n-octyl, benzyl, cyclohexyl, vinyl, and 3-chloropropyl), an aryl group having a C-number of 6 to 20 (e.g., phenyl, 2-naphthyl, m-toluyl, p-methoxyphenyl, and p-carbamoylphenyl), with a coupler residue not being included in R. In formula (I), preferably R represents a hydrogen atom or a straight chain alkyl group with particular preference given to a hydrogen atom.

In formula (I), Y and Z preferably each represent a halogen atom (e.g., F, Cl, Br, and I), an alkyl group having a C-number of 1 to 30 (preferably 1 to 20) (e.g., methyl, n-octyl, and n-hexadecyl), an aryl group having a C-number of 6 to 30 (e.g., phenyl and p-methoxyphenyl), an alkoxy group having a C-number of 1 to 30 (preferably 6 to 20) (e.g., methoxy and n-butoxy), an alkylthio group having a C-number of 1 to 30 (preferably 1 to 20) (e.g., methylthio and n-dodecylthio), an aryloxy group having a C-number of 6 to 30 (preferably 6 to 20) (e.g., phenoxy and p-t-butylphenoxy), an arylthio group having a C-number of 6 to 30 (preferably 6 to 20) (e.g., phenylthio), an alkylsulfonyl group having a C-number of 1 to 30 (preferably 1 to 20) (e.g., methylsulfonyl), an arylsulfonyl group having a C-number of 6 to 30 (preferably 6 to 20) (e.g., p-tolylsulfonyl), a carbonamido group having a C-number of 1 to 30 (preferably 1 to 20) (e.g., acetamido and benzamido), a sulfonamido group having a C-number of 1 to 30 (preferably 1 to 20) (e.g., methanesulfonamido and p-toluenesulfonamido), an acyl group having a C-number of 1 to 30 (preferably 1 to 20) (e.g., acetoxy and benzoyloxy), an acyloxy group having a C-number of 1 to 30 (preferably 1 to 20) (e.g., acetoxy), an alkoxycarbonyl group having a C-number of 2 to 30 (preferably 2 to 20) (e.g., ethoxycarbonyl), a carbamoyl group having a C-number of 1 to 30 (preferably 1 to 20) (e.g., (e.g., N-methylcarbamoyl), a sulfamoyl group having a C-number of 0 to 30 (preferably 0 to 20) (e.g., N-ethylsulfamoyl), a ureido group having a C-number of 1 to 30 (preferably 1 to 20) (e.g., 3-methylureido and 3-phenylureido), an alkoxycabonylamino group having a C-number of 2 to 30 (preferably 2 to 20) (e.g., ethoxycarbonylamino), a cyano group, or a nitro group, with particular preference given to a halogen atom, an alkyl group, an alkoxy group, an acyl group, a carbonamido group, a sulfonamido group, a carbamoyl group, a sulfamoyl group, or a cyano group.

In formula (I), m and n are each an integer of 0 to 4 and where m is 2 or over, substituents Y may be the same or different and may bond together to form a ring except a phthalimido ring. Where n is 2 or over, substituents Z may be the same or different and may bond together to form a ring. Preferably m is 0 or 1 and n is 0 or 1, and particularly preferably m and n are each 0.

The position of the substitution of Y may be any of the 2'-, 3'-, 5'-, and 6'-positions in formula (II). The position of the substitution of Z may be any of the 3-, 5-, 6-, 7-, and 8-positions in formula (I) and preferably is one of the 5-, 6-, and 7-positions.

In formula (I), X represents a hydrogen atom or a coupling-off group capable of being released upon a coupling reaction with the oxidized product of an aromatic primary amine developing agent and preferably represents a hydrogen atom, a halogen atom (e.g., F, Cl, Br, and I), a sulfo group, a thiocyanato group, an alkoxy group having a C-number of 1 to 40 (preferably 12 to 30), an aryloxy group having a C-number of 6 to 40 (preferably 15 to 30), an alkylthio group having a C-number of 1 to 40 (preferably 12 to 30), an arylthio group having a C-number of 6 to 50 (preferably 15 to 30), an alkylsulfonyl group having a C-number of 1 to 40 (preferably 12 to 30), an arylsulfonyl group having a C-number of 6 to 50 (preferably 15 to 30), a heterocyclic oxy group having a C-number of 2 to 46 (preferably 12 to 30), a heterocyclic thio group having a C-number of 2 to 46 (preferably 12 to 30), an acyloxy group having a C-number of 1 to 40 (preferably 12 to 30), a sulfonyloxy group having a C-number of 1 to 40 (preferably 12 to 30), a carbamoyloxy group having a C-number of 2 to 40 (preferably 12 to 0), an azolyl group having a C-number of 1 to 50 (preferably 12 to 40), an imido group having a C-number of 4 to 50 (preferably 12 to 40), or a hydantoinyl group having a C-number of 3 to 50 (preferably 12 to 40).

Particularly preferably X represents a relatively electrophilic group, such as a halogen atom, a sulfo group, an alkylsulfonyl group, a thiocyanato group, a heterocyclic thio group, an azolyl group, or an imido group, because, in that case, stain (white background stain) due to light or heat occurs less.

Specific examples of the substituents in formula (I) are shown below.

Examples of CONHR:

$-CONH_2$ $-CONHC_2H_5$ $-CONHC_3H_7$ $-CONHC_6H_{13}$ $-CONHC_8H_{17}$ $-CONHC_4H_9(i)$

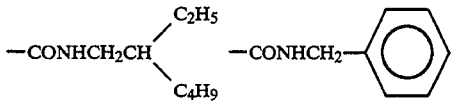

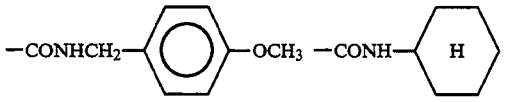

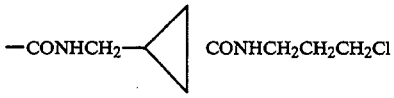

$-CONHCH_2CH_2OC_2H_5$ $-CONHCH{=}CH_2$

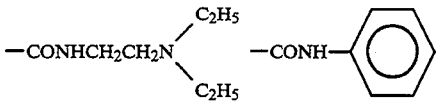

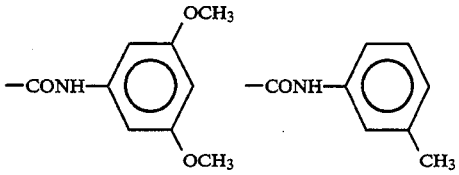

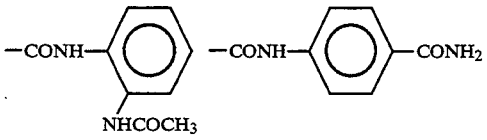

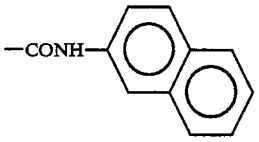

Examples of Y and Z:

F Cl Br I $-CH_3$ $-C_{12}H_{25}$ $-C_{15}H_{31}(t)$ $-OCH_3$ $-OC_{12}H_{25}$ $-OCH_2CH(C_6H_{13})C_8H_{17}$ $-OCH_2CH_2OC_{12}H_{25}$ $-OC_{16}H_{33}$

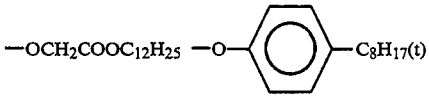

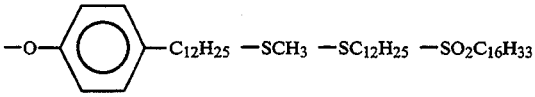

-continued

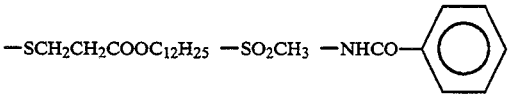

$-NHCOCH_3$ $-NHCOC_{15}H_{31}$ $-NHSO_2CH_3$

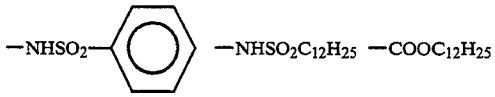

$-COOCH_2CH(C_6H_{13})C_8H_{17}$ $-CONH_2$ $-CONHC_{12}H_{25}$ $-SO_2NHC_2H_5$ $-SO_2NHC_{16}H_{33}$ $-NHCONHCH_3$ $-NHCONHC_{12}H_{25}$ $-CF_3$ $-CN$ $-COCH_3$

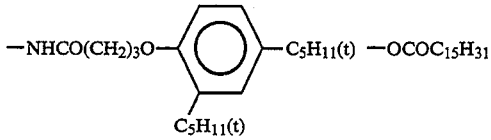

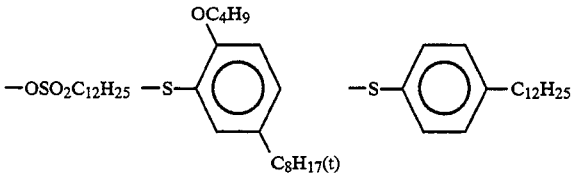

Examples of X:

H F Cl Br I $-SO_3H$ $-SCN$ $-OCH(COOH)C_{12}H_{25}$ $-OCH_2COOCH_2CH(C_2H_5)C_2H_5$ $-OCH(COOCH_3)C_{12}H_{25}$

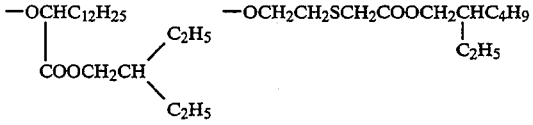

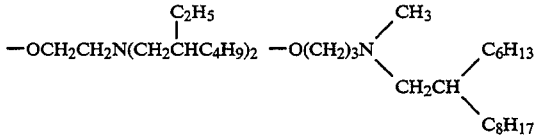

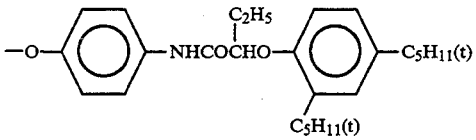

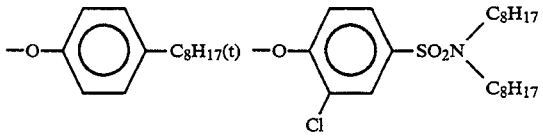

-continued
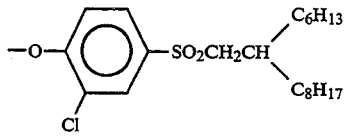
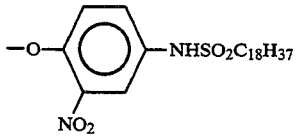
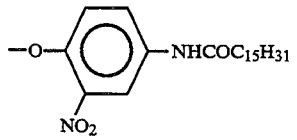
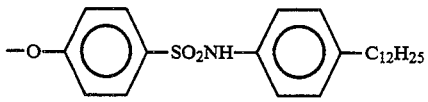
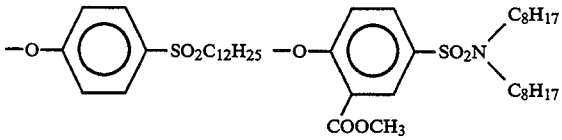
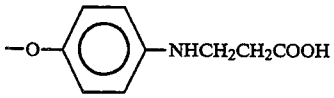
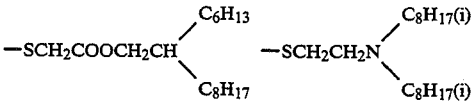
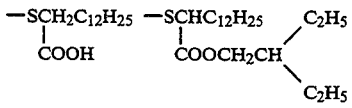
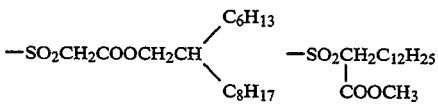
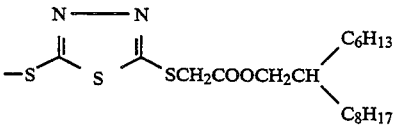
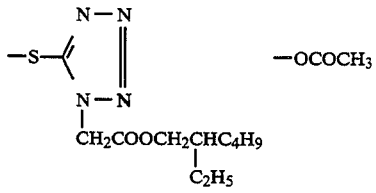
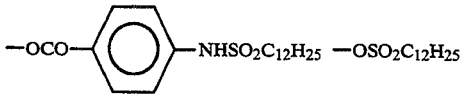
-continued
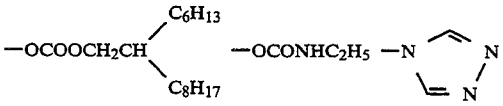
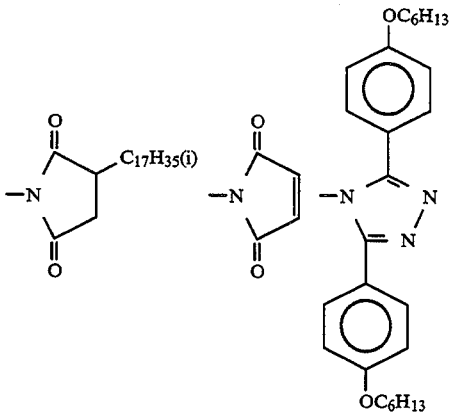
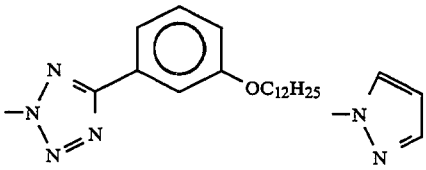
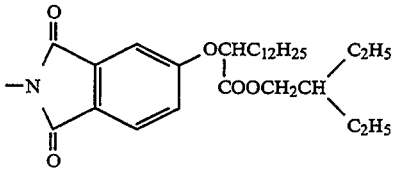
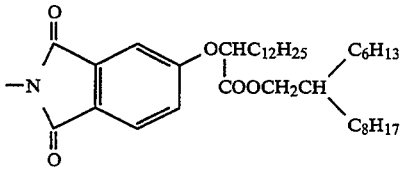
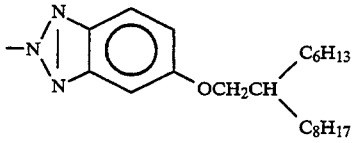
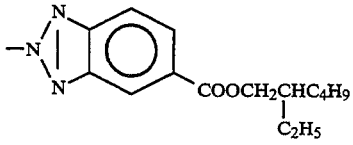
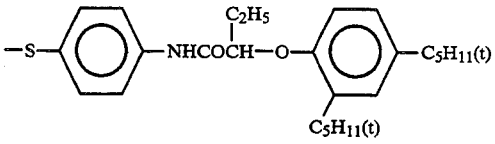
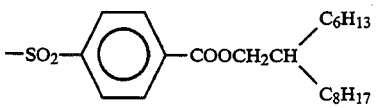

-continued
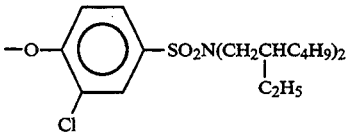
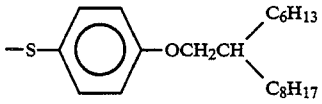
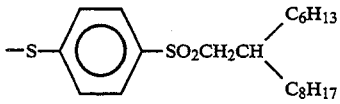
-continued
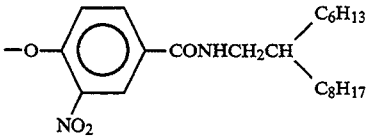
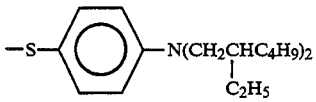
Specific examples of the present cyan coupler are shown, but the compound of the present invention is not restricted to them.
(1)
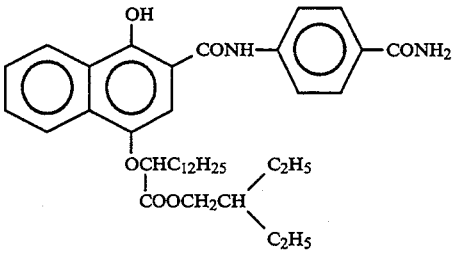
(2)
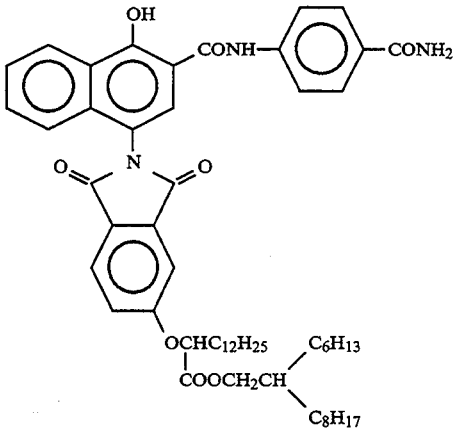
(3)
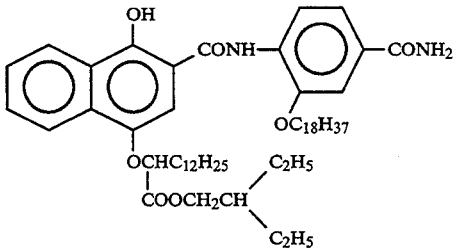
(4)
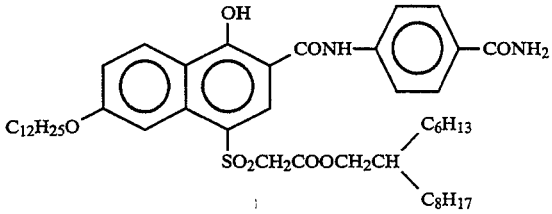

-continued
(5)
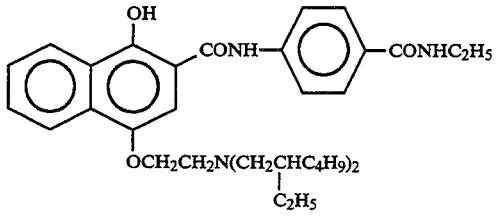
(6)
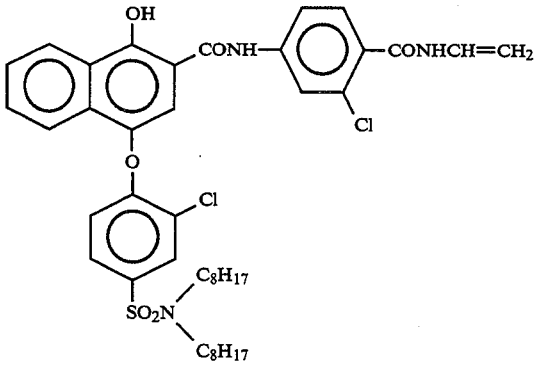
(7)
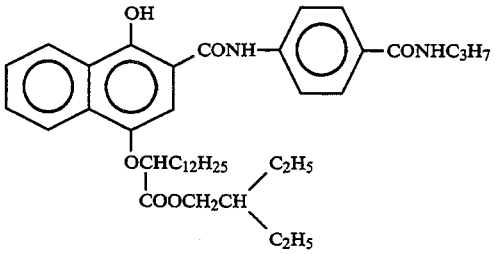
(8)
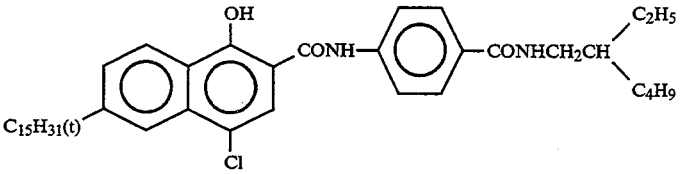
(9)
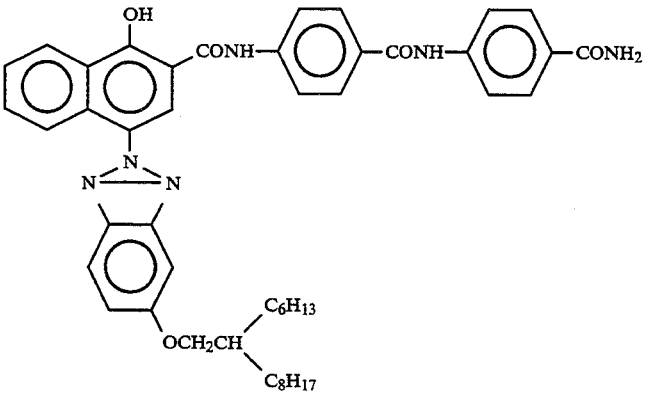

-continued
(10)
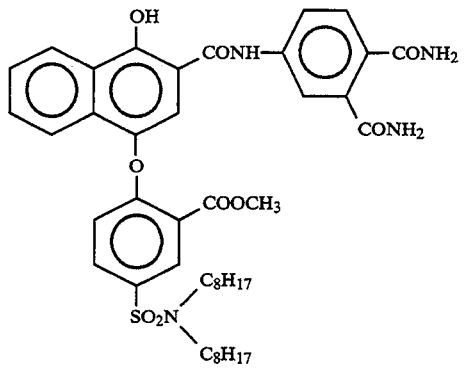
(11)
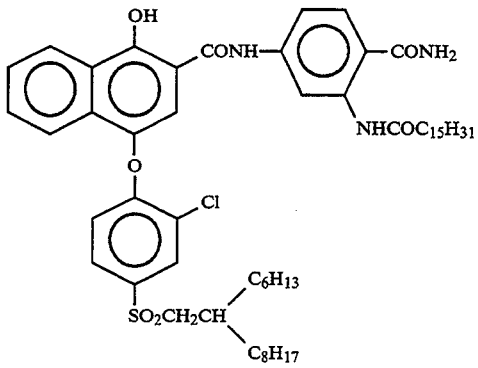
(12)
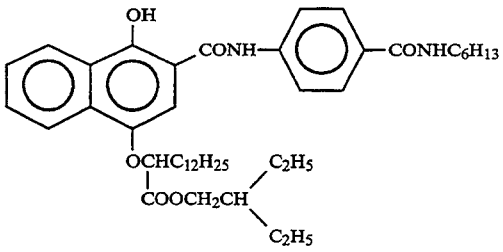
(13)
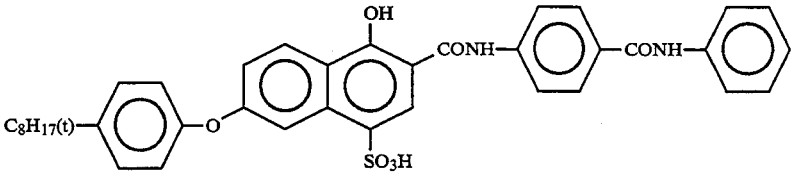
(14)
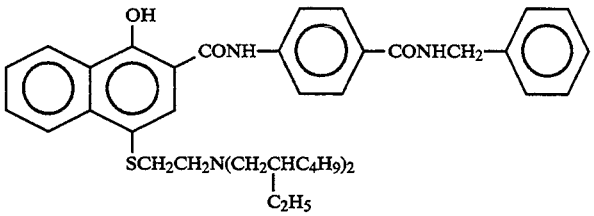

-continued
(15)
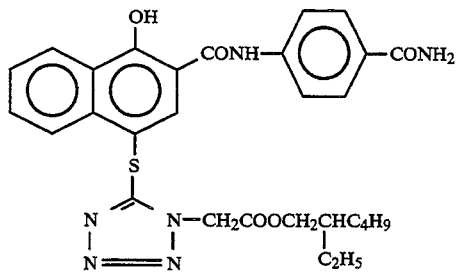
(16)
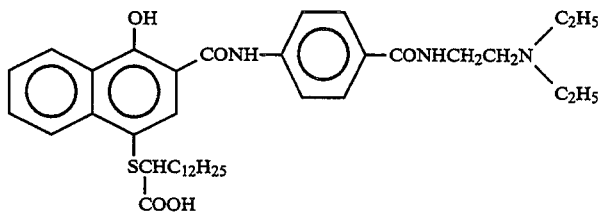
(17)
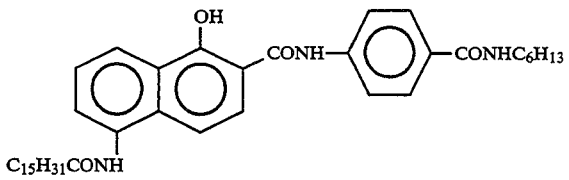
(18)
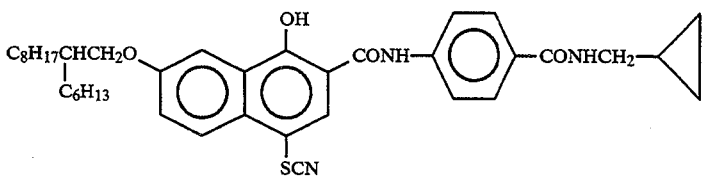
(19)
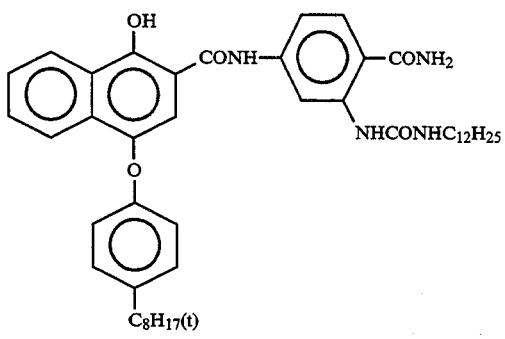
(20)
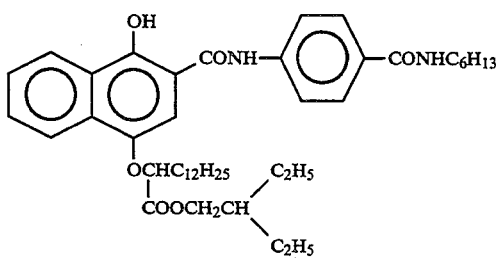

-continued
(21)
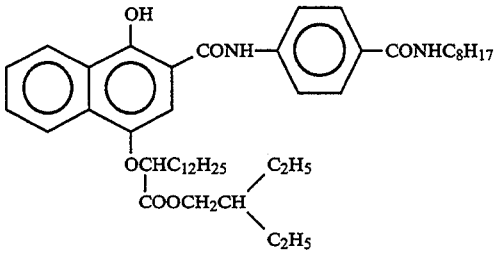
(22)
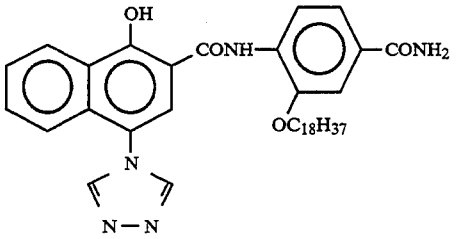
(23)
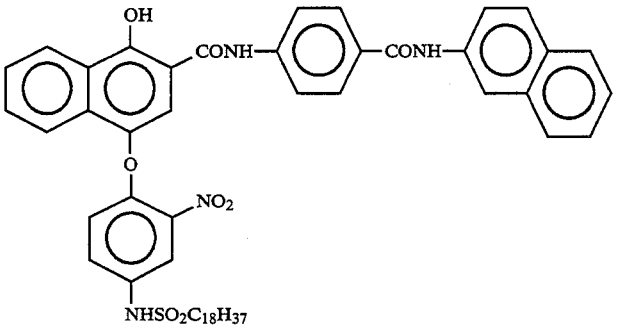
(24)
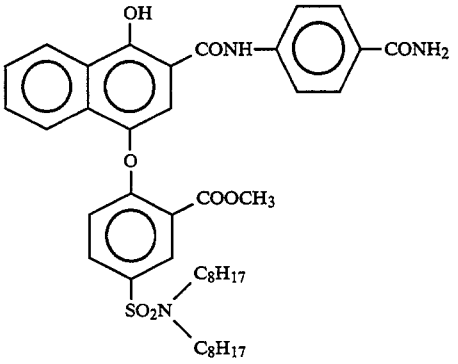
(25)
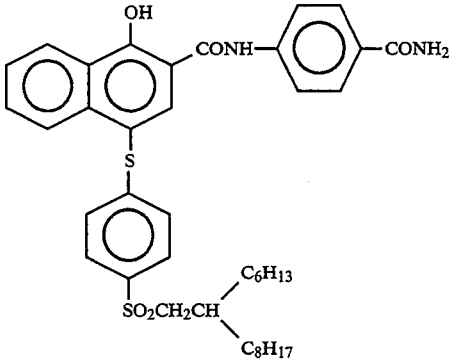

-continued
(26)
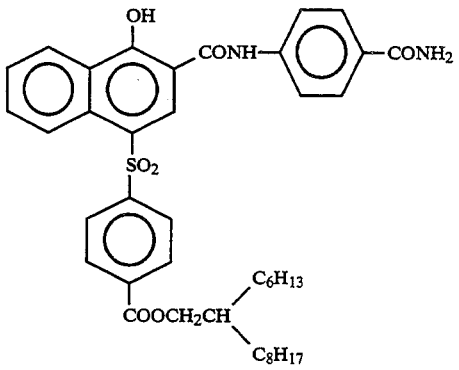
(27)
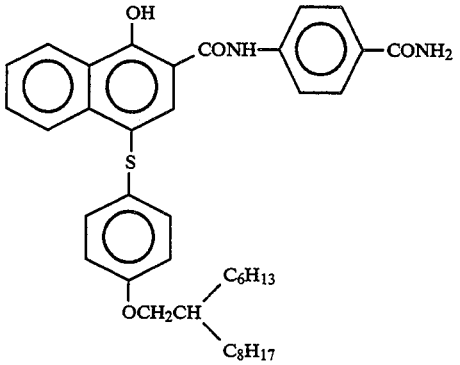
(28)
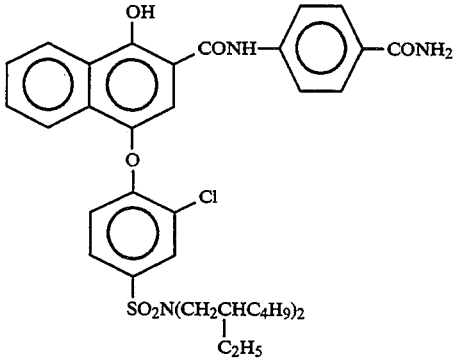
The cyan coupler of the present invention can be synthesized by the method described in JP-A No. 08662/1980 or other conventionally known methods. Synthesis Examples are shown below,
Synthesis Example 1: Synthesis of Exemplified Coupler (1)
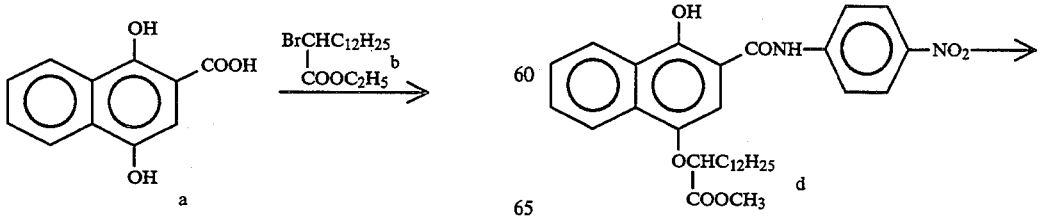
-continued
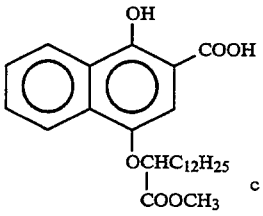

-continued

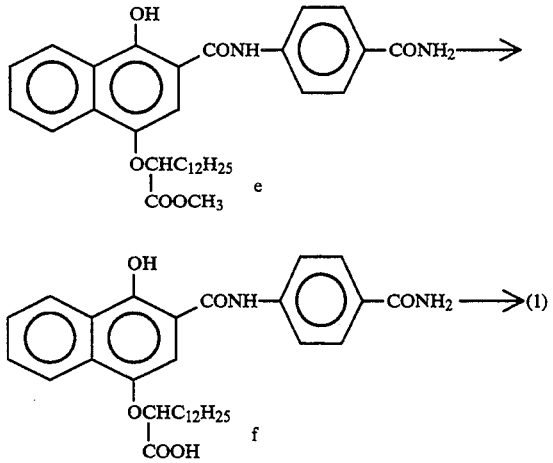

81.7 Grams of Compound (a) was dissolved in 300 ml of DMF and 154 g of a methanol solution containing 28% of sodium methoxide was added dropwise to the solution over 30 min under a flow of nitrogen. Further, 134.1 g of Compound (b) was added dropwise over 30 min at 50° C. with stirring, and the mixture was stirred for a further 2 hours. After cooling, the reaction liquid was poured into 1 liter of water, hydrochloric acid was added thereto to bring the pH to 5, and the deposited crystals were filtered and were washed with water and then methanol, to obtain 167.8 g of crystals of Compound (c).

167.8 Grams of Compound (c) and 53.9 g of p-nitrophenol were dissolved in 500 ml of acetonitrile followed by refluxing, and then 50.0 g of thionyl chloride was added dropwise over 30 min followed by refluxing for 2 hours. After cooling, the deposited crystals were filtered and were washed with acetonitrile and acetone, to obtain 128.3 g of crystals of Compound (d).

54.5 Grams of Compound (d) and 14.5 g of 4-aminobenzamide were dissolved in 100 ml of DMF and the solution was stirred at 150° C. for 2 hours. After distilling off the DMF under reduced pressure, the residue was dispersed in acetonitrile, then was filtered, then washed with acetonitrile, to obtain 46.8 g of crystals of Compound (e).

50 Milliliters of an aqueous solution containing 6.0 g of NaOH was added to 200 ml of a methanol solution containing 44.0 g of Compound (e) at room temperature, followed by stirring for 2 hours. Diluted hydrochloric acid was added thereto and the deposited crystals were filtered and washed with water to obtain Compound (f). After drying Compound (f), 5 ml of concentrated hydrochloric acid and 500 ml of 2-ethylbutanol were added, followed by refluxing for 2 hours while removing the produced water. Then the alcohol was distilled off under reduced pressure and the product was purified by column chromatography using silica gel as a packing material and ethyl acetate/n-hexane (1:1) as a solvent, to obtain 28.1 g of white crystals of Exemplified Coupler (1). The melting point of the compound was 134° to 135° C. and the structure was identified by $_1$HNMR spectrum, mass spectrum, and elemental analysis.

Synthesis Example 2: Synthesis of Exemplified coupler (21)

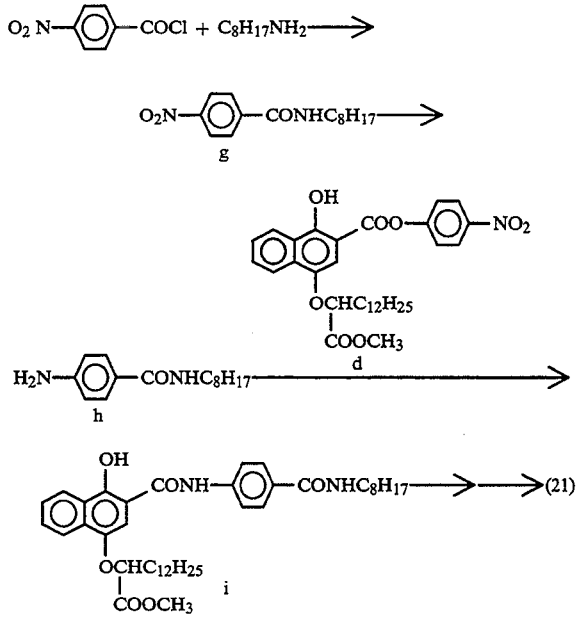

18.6 Grams of p-nitrobenzoyl chloride and 12.1 g of triethylamine were dissolved in 50 ml of DMF, 12.9 g of n-octylamine was added to the solution over 30 min with stirring, and the stirring was continued for 1 hour. Water was added to the reaction liquid, to deposit crystals, and the crystals were filtered, washed with water, and recrystallized from methanol, to obtain 21.3 g of crystals of Compound (g).

200 Milliliters of ethyl acetate was added to 21.3 g of Compound (g) and 1 g of 10% palladium carbon, and the reaction was carried out in an autoclave for 2 hours under a hydrogen pressure of 60 atmospheres.

The palladium carbon was filtered on sellaite and the filtrate was condensed, to obtain 18.9 g of crystals of Compound (h).

12.4 Grams of Compound (h) and 28.3 g of Compound (d) were dissolved in 50 ml of DMF and the solution was stirred for 2 hours at 150° C. After the DMF was distilled off under reduced pressure, the residue was dispersed in methanol, filtered, and washed with methanol, to obtain 28.7 g of crystals of Compound (i).

Similar to Exemplified Coupler (1), 28.7 g of Compound (i) was hydrolyzed and esterified, to obtain 19.0 g of white crystals of Exemplified Coupler (1). This compound had a melting point of 98° to 99° C., and its structure was identified by $^1$HNMR spectrum, mass spectrum, and elemental analysis.

The silver halide photographic material of the present invention has at least one layer containing a cyan coupler represented by formula (I) on a support. The layer containing the present cyan coupler may be a hydrophilic colloid layer on a base. A general color photographic material may be made by applying at least one blue-sensitive silver halide emulsion layer, at least one green-sensitive silver halide emulsion layer, and at least one red-sensitive silver halide emulsion layer in the stated order onto a base, but the order may be changed. An infrared sensitive silver halide emulsion may be used instead of at least one of the above sensitive emulsion layers. By including, in these sensitive emulsion layers, silver halide emulsions sensitive to respective wavelength regions and color couplers capable of forming dyes complementary to the lights to which they are sensitive, the color reproduction by the subtractive color process can be effected. However, the sensitive emulsion layers and the color-formed tones of the color couplers may be constituted differently from the above correspondence.

The hydrophilic colloid layer containing the present cyan coupler on a base includes the above silver halide emulsion layers sensitive to the visible or infrared region or layers adjacent to them. In view of the attainment of the object of the present invention, a photosensitive silver halide emulsion layer is preferable and a red-sensitive silver halide emulsion layer is more preferable.

The amount of the cyan coupler of the present invention to be added is 0.002 to 5 mmol, preferably 0.01 to 2 mmol, per $m^2$.

In the present photographic material, the cyan couplers represented by formula (I) may be used alone or as a mixture of two or more. A cyan coupler other than the cyan coupler represented by formula (I) may also be mixed with the cyan coupler represented by formula (I). However, in that case, the proportion of the cyan coupler represented by formula (I) in all cyan couplers is preferably 50 mol % or more, more preferably 75 mol % or more.

The cyan coupler of the present invention can be incorporated in a photosensitive material by any of various known dispersion methods, for example, an oil-droplet-in-water dispersion method described in U.S. Pat. No. 2,322,027, a polymer dispersion method described in U.S. Pat. No. 4,199,363, West Germany Patent Application (OLS) Nos. 2,451,274 and 2,541,230, and JP-B No. 41091/1978, and a dispersion method using a polymer soluble in an organic solvent.

As the dispersion medium for the couplers to be used in such dispersion methods, it is preferable to use a high-boiling organic solvent and/or a water-insoluble polymer compound having a dielectric constant of 2 to 20 (preferably 2 to 10) (25° C.) and a refractive index of 1.5 to 1.7 (25° C.).

As high-boiling organic solvents, high-boiling organic solvents represented by the following formulae (A) to (E) are preferably used,

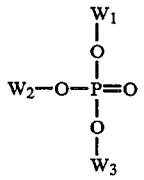
formula (A)

$W_1—COO—W_2$ formula (B)

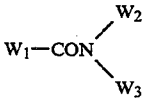
formula (C)

-continued

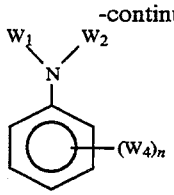
formula (D)

$W_1—O—W_2$ formula (E)

wherein $W_1$, $W_2$, and $W_3$ each represent a substituted or unsubstituted, alkyl group, cycloalkyl group, alkenyl group, aryl group, or heterocyclic group, $W_4$ represents $W_1$, $O—W_1$ or $S—W_1$, n is an integer of 1 to 5, when n is 2 or over, $W_4$ groups may be the same or different, and in formula (E), $W_1$ and $W_2$ may together form a condensed ring.

As particularly preferable high-boiling organic solvent, high-boiling organic solvents, such as phthalates (e.g., dibutyl phthalate and dioctyl phthalate), aliphatic esters (e.g., dibutoxyethyl succinate), phosphates (e.g., trioctyl phosphate), and chlorinated paraffins can be mentioned.

As the high-boiling organic solvent to be used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The present cyan coupler is preferably dissolved in the above-mentioned high-boiling organic solvent (low-boiling organic solvents may be used in combination, if necessary), and then emulsified and dispersed in a aqueous gelatin solution to add into a silver halide emulsion. The high-boiling organic solvent may be used in an weight ratio to coupler of 0 to 2.0, preferably 0 to 1.0. The present cyan coupler can be dispersed stably compared with other cyan couplers even in 0 to 0.1 weight ratio of high-boiling organic solvent.

The present cyan coupler can be adapted to, for example a color paper, a color reversal paper, a direct positive color photosensitive material, a color positive film, and a color reversal film. Among them, applications to color photosensitive materials having a reflective support (e.g., color paper and color reversal paper) and color photosensitive materials to form positive image (e.g., direct positive color photosensitive material, color positive film, and color reversal film) are preferable, and applications to color photosensitive material having a reflective support are particularly preferable.

With respect to silver halide emulsion to be used in the present invention, any of halogen compositions including silver iodobromide, silver iodochlorobromide, silver bromide, silver chlorobromide, and silver chloride can be used.

Preferable halide composition may be different due to the kind of photosensitive material to be applied. For example, a silver chlorobromide emulsion is mainly used for color papers, a silver iodobromide emulsion is used for photographic materials for photographing, such as color negative film, and a silver bromide emulsion or a silver chlorobromide emulsion is used for direct positive color photographic materials. A so-called high-silver-chloride emulsion that has a high silver chloride content is preferably used for color photographic papers suitable for a rapid processing.

In the present invention, one comprising silver chlorobromide or silver chloride being substantially free from silver iodide can be preferably used. Herein the term "substantially free from silver iodide" means that the silver iodide content is 1 mol % or below, and preferably 0.2 mol % or below.

Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

With respect to the halogen composition of such silver chlorobromide emulsion, the content of silver chloride is generally 90 mol % or more, and preferably 95 mol % or more. By containing 90 mol % or more of silver chloride, the color formation at a rapid processing is improved, and the color-mixing is surprisingly prevented.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or more, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

As the emulsion used in the present invention, use is made of either a so-called surface-sensitive emulsion, wherein a latent image is formed mainly on the grain surface, or a so-called internal-image emulsion, wherein a latent image is formed mainly within the grains.

The silver halide photographic emulsions that can be used in the present invention may be prepared suitably by known means, for example, by the methods described in I. Emulsion Preparation and Types, in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisique Photographique*, Paul Montel (1967), in G. F. Duffin, *Photographic Emulsion Chemistry*, Focal Press (1966), and in V. L. Zelikman et al., Making and *Coating of Photographic Emulsion*, Focal Press (1964).

A monodisperse emulsion, such as described in U.S. Pat. Nos. 3,574,628 and 3,655,394, and in British Patent No. 1,413,748, is also preferable.

Tabular grains having an aspect ratio of 5 or greater can be used in the present invention.

The silver halide emulsion for use in the present invention is generally one that has been physically ripened, chemically ripened, and spectrally sensitized.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

Additives to be used in the physical ripening step, chemical ripening step, and spectral sensitization step of silver halide emulsion for use in the present invention are described in *Research Disclosure* Nos. 17643, 18716 and 307105, and involved sections are listed in the Table shown below. Known photographic additives that can be used in the present invention are also described in the above-mentioned three Research Disclosures, and involved sections are listed in the same Table below.

| | Additive | RD 17643 | RD 18716 | RD 307105 |
|---|---|---|---|---|
| 1 | Chemical sensitizer | p. 23 | p. 648 (right column) | p. 866 |
| 2 | Sensitivity-enhancing agent | — | p. 648 (right column) | — |
| 3 | Spectral sensitizers and Supertabilizers | pp. 23–24 | pp. 648 (right column)–649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants Lubricants | p. 27 | p. 650 (right column) | p. 876 |
| 12 | Coating aids and Surface-active agents | pp. 26–27 | p. 650 (right column) | pp. 875–876 |
| 13 | Antistatic agents | p. 27 | p. 650 (right column) | pp. 876–877 |
| 14 | Matting agent | — | — | pp. 878–879 |

Further, in order to prevent the lowering of photographic performances due to formaldehyde gas, a compound described in, for example, U.S. Pat. Nos. 4,411,987 and 4,435,503 that is able to react with formaldehyde to immobilize is preferably added to the photographic material.

In the present invention, various color couplers can be simultaneously used, and concrete examples of them are described in patents cited in the above-mentioned *Research Disclosure* No. 17643, VII-C to G, and ibid. No. 307105, VII-C to G.

Standard amount for combined use of color couplers is in the range of 0.001 to 1 mol, and preferably 0.01 to 0.5 mol for yellow couplers, 0.003 to 0.3 mol for magenta couplers, and 0.002 to 0.3 mol for cyan couplers, per mol of photosensitive silver halide.

As additives that can be used in the present invention, other than those in above mentioned *Research Disclosures*, there can be mentioned, for example, oxonol dyes described in European Patent No. 337,490A2; image-dye preservability-improving compounds described in European Patent No. 277589; antifungal agents described in JP-A No. 271247/1988; silver halide emulsions, solvents for silver halide, chemical sensitizers, spectral sensitizers, emulsion stabilizers, development accelerators, color couplers, color forming-increasing agents, ultraviolet ray absorbers, discoloration inhibitors, high-boiling or low-boiling organic solvents, film hardeners, developing-agent precursors, development retarders, releasing compounds, dyes, gradation regulators, stain inhibitors, surface-active agents, antistatic agents, coating aids, lubricators, adhesion-inhibitors, binders, thickeners, polymer latices, and matting agents described in JP-A Nos. 215272/1987 and 33144/1990, European Patent No. 355,660. Further, dispersion methods for photographic additives, supports, photosensitive layers, and compositions thereof are also described in the above patents.

Suitable supports to be used in this invention are described in, for example, the above-mentioned *Research Disclosure* No. 17643, page 28 and No. 18716, from page 647, right column to page 648, left column.

The film swelling speed $T_{\frac{1}{2}}$ of the present photosensitive material is preferably 30 sec or below, more preferably 20 sec or below. The "layer thickness" means layer thickness measured after moisture conditioning at 25° C. and a relative humidity of 55% for two days, and the film swelling speed $T_{\frac{1}{2}}$ can be measured in a manner known in the art. For example, the film swelling speed $T_{\frac{1}{2}}$ can be measured by using a swellometer (swell-measuring meter) of the type described by A. Green et al. in *Photographic Science and Engineering*, Vol. 19, No. 2, pp. 124–129, and $T_{\frac{1}{2}}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{\frac{1}{2}}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness—-film thickness)/Film thickness.

The photographic material in accordance with the present invention can be subjected to the development processing by an ordinary method as described in the above-mentioned *RD* No. 17643, pp. 28–29, ibid. No.

18716, p. 651, from left column to right column, and ibid. No. 307105, pp. 880–881.

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and their sulfates, hydrochlorides, and p-toluenesulfonates. Among these, 3-methyl-4-amino-N-ethyl-β-methanesulfonamidoethylaniline sulfate and 3-methyl-4-amino-N-ethyl-N-β-hydroxyethylaniline sulfate are preferable. A combination of two or more of these compounds may be used in accordance with the purpose.

The color developer generally contains, for example, pH-buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents, such as ethylene glycol and diethylene glycol, development accelerators, such as benzyl alcohol, polyethylene glycol, quaternary ammonium salts, and amines, dye-forming couplers, competing couplers, auxiliary developers, such as 1-phenyl-3-pyrazolidone, tackifiers, and various chelating agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination. Generally the pH of this color developer and black-and-white developing solution is 9 to 12. The replenishing amount of these developing solutions is generally 3 liter or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air.

The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $\text{cm}^{-1}$ or less, more preferably 0.001 to 0.05 $\text{cm}^{-1}$. Methods for reducing the opened surface ratio that can be mentioned include a utilization of movable lids as described in JP-A No. 82033/1989 and a slit-developing process as described in JP-A No. 216050/1988, besides a method of providing a shutting materials such as floating lids. It is preferable to adopt the means for reducing the opened surface ratio not only in a color developing and black-and-white developing process but also in all succeeding processes, such as bleaching, bleach-fixing, fixing, washing, and stabilizing process. It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layer are generally subjected to a bleaching process after color development. The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, but if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 3,893,858, West German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/1978, and 28426/1978, and *Research Disclosure* No. 17129 (July, 1978); thiazolidine derivatives, described in JP-A No. 140129/1975; thiourea derivatives, described in JP-B No. 8506/1970, JP-A Nos. 20832/1977 and 32735/1978, and U.S. Pat. No. 3,706,561; iodide salts, described in West German Patent No. 1,127,715 and JP-A No. 16235/1983; polyoxyethylene compounds in West German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.S. Pat. No. 3,893,858, West German Patent No. 1,290,812, and JP-A No. 95630/1978 are preferable. Further, compound described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, an organic acid is preferably contained in the bleach solution or bleach-fix solution in order to prevent bleach stain. A particularly preferable organic acid is a compound having an acid dissociation constant (pKa) of 2 to 5, and specifically, for example, acetic acid and propionic acid are preferable.

As a fixing agent to be used in the fixing solution and the bleach-fix solution, thiosulfates, thiocyanates, thioether compounds, thioureas, and large amounts of iodides can be mentioned, although thiocyanates are used generally, and particularly ammonium thiosulfate is used most widely. A combination, for example, of a thiosulfate with a thiocyanate, a thioether compound, or thiourea is also used preferably. As preservatives for the fixing solution or the bleach-fix solution, sulfites, bisulfites, carbonyl bisulfite adducts, and sulfinic acid compounds described in European Patent No. 294,769A are preferable. Further, in order to stabilize the fixing solution or the bleach-fix solution, the addition of various aminopolycarboxylic acids or organic phosphonic acids to the solution is preferable.

In the present invention, to the fixing solution or the bleach-fix solution, a compound having a pKa of 6.0 to 9.0, preferably an imidazole, such as imidazole, 1-methylimidazole, 1-ethylimidazole, and 2-methylimidazole, is added in an amount of 0.1 to 10 mol/l in order to adjust the pH.

The total period of the desilvering step is preferably made shorter within the range wherein silver retention will not occur. A preferable period is 1 to 3 min, more preferably 1 to 2 min. The processing temperature is 25° to 50° C., preferably 35° to 45° C. In a preferable temperature range, the desilvering speed is improved and the occurrence of stain after the processing can effectively be prevented.

In the desilvering step, preferably the stirring is intensified as far as possible. Specific methods for intensifying the stirring are a method described in JP-A No. 183460/1987, wherein a jet stream of a processing solution is applied to the emulsion surface of the photographic material; a method described in JP-A No. 183461/1987, wherein the stirring effect is increased by using a rotating means; a method wherein a photographic material is moved with a wiper blade placed in a solution in contact with the emulsion surface, to cause a turbulent flow to occur over the emulsion surface to improve the stirring effect, and a method wherein the amount of the circulating flow of the whole processing solution is increased. Such stirring improvement means are effective for any of the bleaching solution, the bleach-fix solution, and the fixing solution. The improvement of stirring seems to quicken the supply of the bleaching agent and the fixing agent to the emulsion coating, thereby bringing about an increase of the desilvering speed. The above stirring improvement means is more effective when a bleach accelerator is used and the means can increase the acceleration effect remarkably or can cancel the fixing inhibiting effect of the bleach accelerator.

Preferably, the automatic processor used for the present photographic material is provided with a photographic material conveying means described in JP-A Nos. 191257/1985, 191258/1985, and 191259/1985. As described in 191257/1985 mentioned above, such a conveying means can reduce extraordinarily the carry-in of the processing solution from one bath to the next bath, and therefore it is highly effective in preventing the performance of the processing solution from deteriorating. Such an effect is particularly effective in shortening the processing time in each step and in reducing the replenishing amount of the processing solution.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No.

8542/1982, benzotriazoles, and other bactericides described by Hiroshi Horiguchi in *Bokin Bobai-zai no Kagaku*,. (1986) published by Sankyo-Shuppan, *Biseibutsu no. Mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehyde (e.g., formalin and gulaldehyde), N-methylol compound, hexamethylenetetramine and aldehyde-sulfite adduct. In this stabilizing bath, each kind of the chelating agents and bactericides may be added.

The over-flowed solution due to the replenishing of washing solution and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

Further, the silver halide photographic material of the present invention can be adopted to photographic materials for heat development described in, for example, U.S. Pat. No. 4,500,626, JP-A Nos. 133449/1985, 218443/1894, and 238056/1986, and European Patent No. 210,660A.

The cyan coupler of the present invention can form a cyan dye excellent in spectral absorption characteristics, and the dye has excellent fastness properties to heat, light, and humidity. Therefore, the silver halide color photographic material of the present invention can give an image good in color reproduction, and excellent in the stabilities of hue and density.

Next, the present invention will be described in detail in accordance with examples, but the invention is not limited to them.

EXAMPLE 1

A mono-color-forming photosensitive material Sample 101 comprising two layers of an emulsion layer and a protective layer composition of which are shown below was prepared on a triacetate cellulose film support which had been provided a prime coat. The figures represent coating amount in g/m$^2$ of constituents, except coupler. As to silver halide, the coating amount is shown in terms of silver.

| | |
|---|---|
| Emulsion layer: | |
| Silver chlorobromide emulsion (silver chloride: 80 mol %, average grain diameter: 0.3 μm) | silver 0.8 |
| Gelatin | 1.2 |
| Cyan coupler A (See Table 1) | 0.001 mol/m$^2$ |
| Dibutyl phthalate | 0.3 |
| Protective layer: | |
| Gelatin | 0.9 |
| Poly(methyl methacrylate) particle (diameter: 1.5 μm) | 0.4 |
| Sodium 1-oxy-3,5-dichloro-s-triazinate | 0.04 |

Samples 102 to 104 were prepared in the same manner as Sample 101, except that the cyan coupler A was replaced with couplers shown in Table 1, respectively.

Samples thus prepared were processed in the manner shown below.

First, each of samples was subjected to a gradation exposure to red light through three color separated filter for sensitometry using a sensitometer (FWH model made by Fuji Photo Film Co., Ltd., the color temperature of light source was 3200 K.). At that time, the exposure was carried out in such a manner that the exposure amount was 250 CMS with the exposure time being 0.1 sec.

After exposure to light, each sample was processed according to the following processing process and processing solutions using an automatic developer.

| Processing process | Temperature | Time |
|---|---|---|
| Color developing | 37° C. | 3 min 30 sec |
| Bleach-fixing | 33° C. | 1 min 30 sec |
| Water washing | 24–34° C. | 3 min |
| Drying | 70–80° C. | 1 min |

Compositions of each processing solution were as follows:

| | |
|---|---|
| Color developer | |
| Water | 800 ml |
| Diethylenetriaminepentaacetic acid | 1.0 g |

-continued

| | |
|---|---|
| Nitrilotriacetic acid | 2.0 g |
| Sodium sulfite | 0.2 g |
| Potassium bromide | 1.0 g |
| Potassium carbonate | 30 g |
| N-Ethyl-N-(β-methanesulfonamidoethyl)-3-methyl-4-aminoaniline sulfonate | 4.5 g |
| Hydroxylamine sulfate | 3.0 g |
| Fluorescent brightening agent (WHITEX 4B, made by Sumitomo Chem. Co., Ltd.) | 1.0 g |
| Water to make | 1,000 ml |
| pH (25° C.) | 10.25 |
| Bleach-fixing solution | |
| Water | 400 ml |
| Ammonium thiosulfate (700 g/l) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Water to make | 1000 ml |
| pH (25°) | 6.0 |
| Water washing solution | |
| Ion-exchanged water (calcium and magnesium are each 3 ppm or below) | |

With respect to cyan-colored each Sample by the above processing, spectrum of maximum density part was determined by a spectrophotometer (Model U-3500, made by Hitachi Seisakusho). In FIG. 1, spectrum of Sample 101 and 103 are shown as representatives of 4 Samples.

Then, the above Samples were kept for one day under a condition of 80° C. and 70% RH, and were determined spectrum in the same manner as the above described. Maximum absorption wavelength (λmax) and absorbance (maximum absorbance) at λmax of each Sample are shown in Table 1.

TABLE 1

| Sample No. | Cyan coupler | After processing λmax (nm) | After processing Maximum absorbance | After storage for 1 day at 80° C., 70% RH λmax (nm) | After storage for 1 day at 80° C., 70% RH Maximum absorbance | Remarks |
|---|---|---|---|---|---|---|
| 101 | A | 654 | 2.05 | 655 | 2.02 | Comparison |
| 102 | B | 646 | 1.99 | 652 | 1.45 | Comparison |
| 103 | 1 | 637 | 1.93 | 640 | 1.97 | Invention |
| 104 | 24 | 642 | 1.88 | 644 | 1.95 | Invention |

Note;
Coupler A

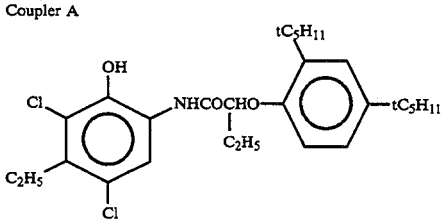

Coupler B

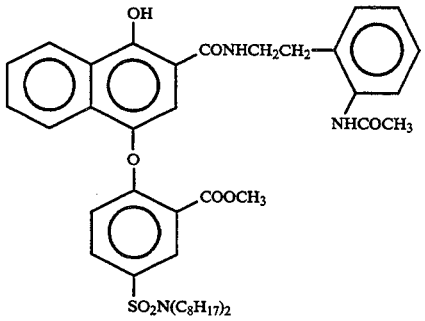

As is apparent from FIG. 1, the cyan coupler of this invention gives good cyan dye including less magenta hue. Further, as is apparent from the results in Table 1, changes of hue and color density of the present coupler in storage are specifically small compared with the conventional coupler B (described in U.S. Pat. No. 4,960,685). Although the cyan coupler described in the above mentioned U.S. Patent is close structurally to the coupler of the present invention, the effect of the present invention is not disclosed or suggested in the U.S. Patent.

EXAMPLE 2

When The same processing and procedure as in Example 1 were conducted by using Exemplified couplers (2), (4), and (7) of the present invention instead of Exemplified couplers (1) or (2), results very similar to those in Example 1 were obtained.

EXAMPLE 3

A multilayer color print paper Sample 301 having layer compositions shown below was prepared on a paper support laminated on both sides thereof with polyethylene film, subjected to a corona discharge on the surface, and provided a gelatin prime coat-layer containing sodium dodecylbenzenesulphonate. Coating solutions were prepared as follows:

Preparation of the First Layer Coating Solution 19.1 Grams of yellow coupler (ExY), 4.4 g of image-dye stabilizer (Cpd-1), and 0.7 g of image-dye stabilizer (Cpd-7) were added and dissolved to a mixture of 27.2 ml of ethyl acetate and each 4.1 g of solvent (Solv-3) and solvent (Solv-7). The resulting solution was dispersed and emulsified in 185 ml of 10% aqueous gelatin solution containing 8 ml of sodium dodecylbenzenesulfonate, thereby prepared emulsified dispersion A. Separately silver chlorobromide emulsion A (cubic grains, 3:7 (silver molar ratio) blend of large size grain emulsion A and small size grain emulsion A having 0.88 μm and 0.70 μm of average grain size, the deviation coefficients of which grain size were 0.08 and 0.10, respectively, each in which 0.3 mol % of silver bromide was located at the surface of grains and the remainder was silver chloride) was prepared. Blue-sensitive sensitizing dyes A and B, shown below, were added in this emulsion in such amounts of $2.0\times10^{-4}$ mol to the large size emulsion A and $2.5\times10^{-4}$ mol to the small size emulsion A, per mol of silver, respectively. The chemical ripening was carried out by adding sulfur and gold sensitizing agents. The above-described emulsified dispersion A and this emulsion A were mixed together and dissolved to give the composition shown below, thereby preparing the first layer coating solution. Coating solutions for the second to the seventh layer were also prepared in the same manner as the first layer coating solution. As a gelatin hardener for the respective layers, 1-hydroxy-3,5-dichloro-s-triazine sodium salt was used.

In each layer Cpd-10 and Cpd-11 were added in such amount that the total amounts are 25.0 mg/m$^2$ and 50.0 mg/m$^2$, respectively.

As spectral-sensitizing dyes for the respective silver chlorobromide emulsion in photosensitive emulsion layers, the following compounds were used:

Sensitizing dye A for blue-sensitive emulsion layer

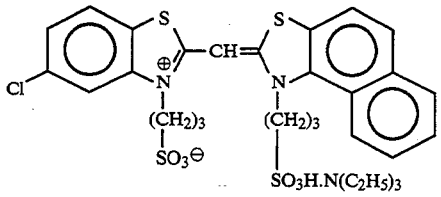

Sensitizing dye B for blue-sensitive emulsion layer

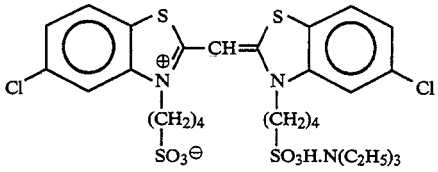

(each $2.0\times10^{-4}$ mol to the large size emulsion A and $2.5\times10^{-4}$ mol to the small size emulsion A, per mol of silver halide.)

Sensitizing dye C for green-sensitive emulsion layer

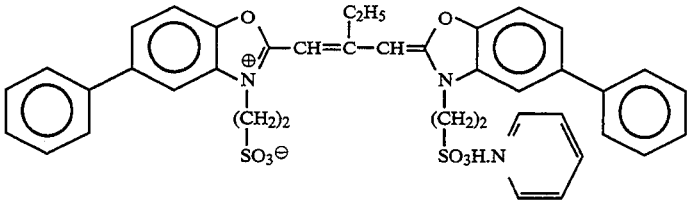

($4.0\times10^{-4}$ mol to the large size emulsion B and $5.6\times10^{-4}$ mol to the small size emulsion B, per mol of silver halide)

Sensitizing dye D for green-sensitive emulsion layer

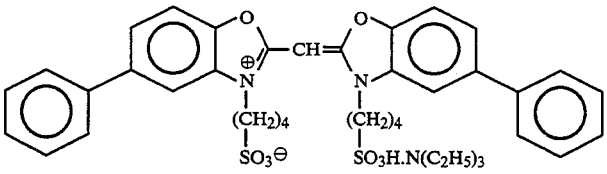

($7.0\times10^{-5}$ mol to the large size emulsion and $1.0\times10^{-5}$ mol to the small size emulsion, per mol of silver halide)

Sensitizing dye E for red-sensitive emulsion layer

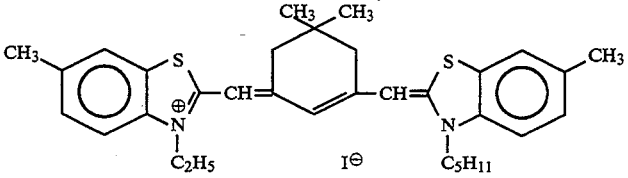

($0.9\times10^{-4}$ mol to the large size emulsion C and 1.1 × $10^{-4}$ mol to the small size emulsion C, per mol of silver halide)

To the red-sensitive emulsion layer, the following compound was added in an amount of $2.6\times10^{-3}$ mol per mol of silver halide:

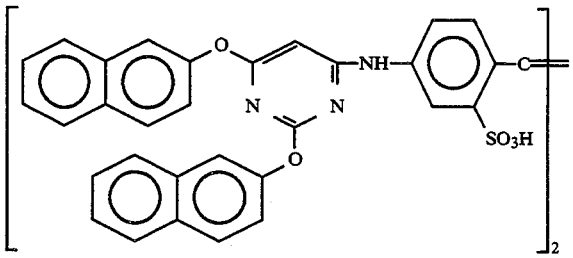

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

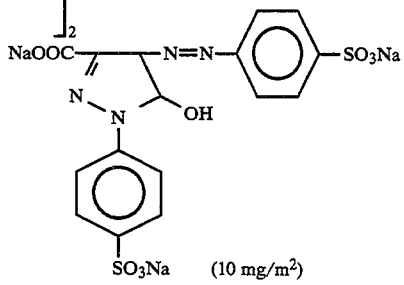

(10 mg/m²)

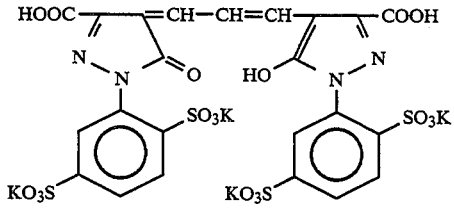

(10 mg/m²)

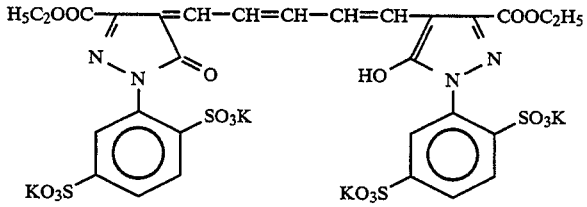

(40 mg/m²)

and

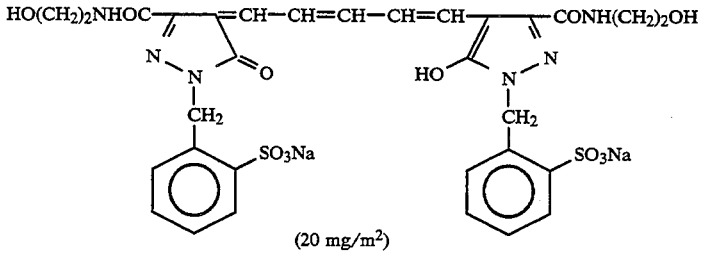

(20 mg/m²)

(Composition of Layers)

The composition of each layer is shown below. The figures represent coating amount (g/m2). The coating amount of each silver halide emulsion is given in terms of silver.

| | |
|---|---|
| Supporting Base | |
| Paper laminated on both sides with polyethylene (a white pigment, $TiO_2$, and a bluish dye, ultramarine, were included in the first layer side of the polyethylene-laminated film) | |
| First Layer (Blue-sensitive silver halide emulsion layer) | |
| The above described silver chlorobromide emulsion A | 0.30 |
| Gelatin | 1.22 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second Layer (Color-mix preventing layer) | |
| Gelatin | 0.64 |
| Color-mix inhibitor (Cpd-5) | 0.10 |
| Solvent (Solv-1) | 0.16 |
| Solvent (Solv-4) | 0.08 |
| Third Layer (Green-sensitive silver halide emulsion layer) | |
| Silver chlorobromide emulsions (cubic grains, 1:3 (Ag mol ratio) blend of large size emulsion having average grain size of 0.55 μm and small size emulsion having average grain size of 0.39 μm, each of whose deviation coefficient of grain size distribution is 0.10 and 0.08, respectively, each in which 0.8 mol % of AgBr was located at the surface of grains and the remainder was silver chloride) | 0.12 |
| Gelatin | 1.28 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet rays-absorbing layer) | |
| Gelatin | 1.41 |
| Ultraviolet-absorber (UV-1) | 0.47 |
| Color-mix inhibitor (Cpd-5) | 0.05 |
| Solvent (Solv-5) | 0.24 |
| Fifth Layer (Red-sensitive silver halide emulsion layer) | |
| Silver chlorobromide emulsions (cubic grains, 1:4 (Ag mol ratio) blend of large size emulsion having average grain size of 0.58 μm and small size emulsion having average grain size of 0.45 μm, each of whose deviation coefficient of grain size distribution is 0.09 and 0.11, respectively, each in which 0.6 mol % of AgBr was located at the surface of grains and the remainder was silver chloride) | 0.23 |
| Gelatin | 1.04 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet rays-absorbing layer) | |
| Gelatin | 0.48 |
| Ultraviolet absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.10 |
| Acryl-modified copolymer of polyvinyl alcohol (modification degree: 17%) | 0.17 |
| Liquid paraffin | 0.03 |

Compounds used are as follows:
(ExY) Yellow coupler
Mixture (1:1 in molar ratio) of

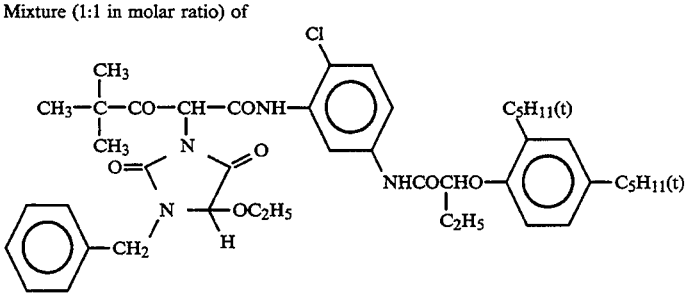

and

-continued
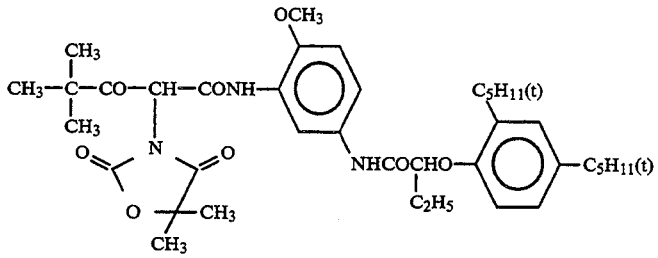
(ExM) Magenta coupler
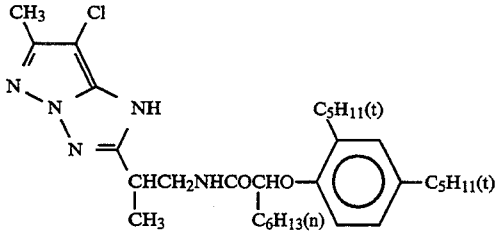
(ExC) Cyan coupler
Mixture (1:1 in molar ratio) of
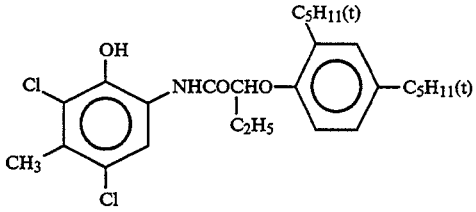
and
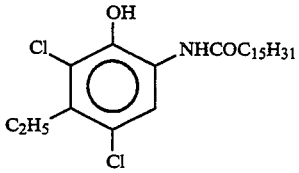
(Cpd-1) Image-dye stabilizer
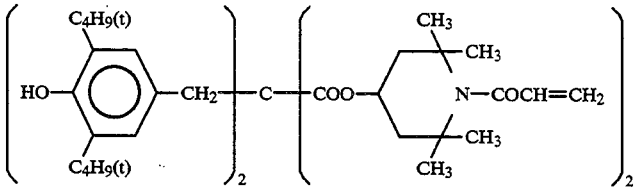
(Cpd-2) Image-dye stabilizer
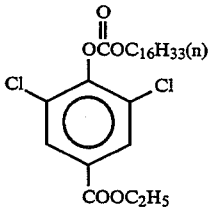
(Cpd-3) Image-dye stabilizer
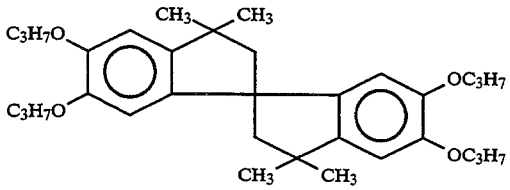
(Cpd-4) Image-dye stabilizer -continued
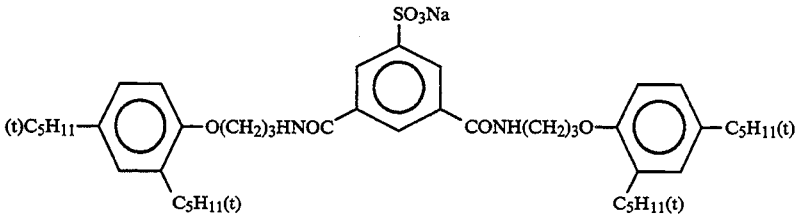
(Cpd-5) Color-mix inhibitor
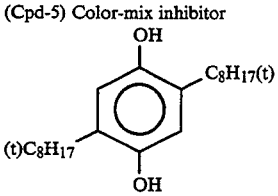
(Cpd-6) Image-dye stabilizer
Mixture (2:4:4 in weight ratio) of
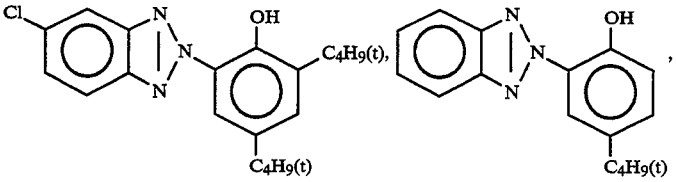
and
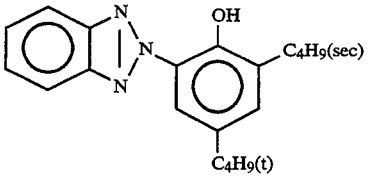
(Cpd-7) Image-dye stabilizer
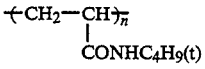
Average molecular weight: 60,000
(Cpd-8) Image-dye stabilizer
Mixture (1:1 in weight ratio) of
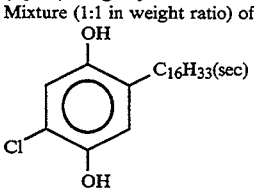
and
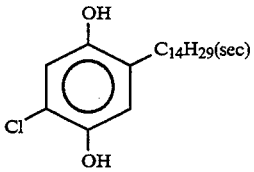
(Cpd-9) Image-dye stabilizer
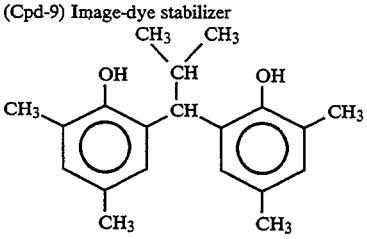
(Cpd-10) Antiseptic
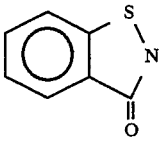
(Cpd-11) Antiseptic
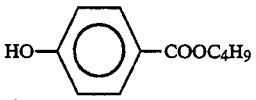
(UV-1) Ultraviolet ray absorber -continued Mixture (4:2:4 in weight ratio) of

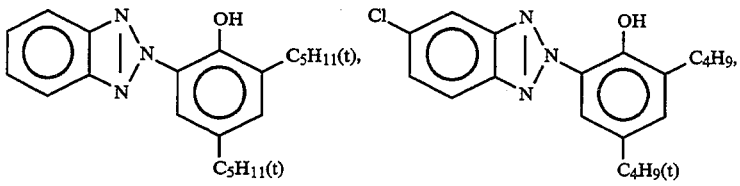

and

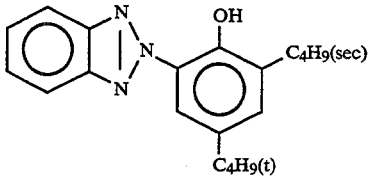

(Solv-1) Solvent

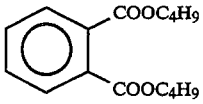

(Solv-2) Solvent
Mixture (1:1 in volume ratio) of

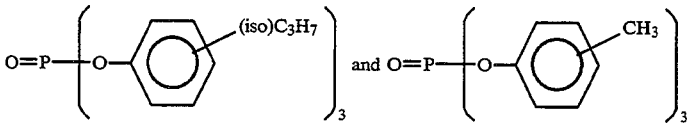

(Solv-3) Solvent
$O{=}P{-}(O{-}C_9H_{19}(iso))_3$ (Solv-4) Solvent

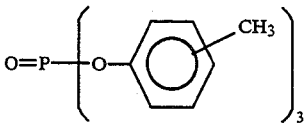

(Solv-5) Solvent

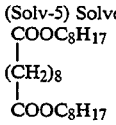

(Solv-6)
Mixture (80:20 in volume ratio) of

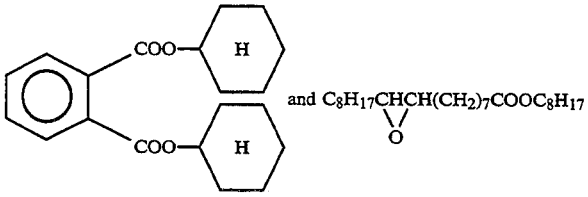

(Solv-7)
$C_8H_{17}CHCH(CH_2)_7COOC_8H_{17}$
$\backslash\ /$
$O$

Color print paper Sample 302 was prepared in the same manner as Sample 301, except that the present Exemplified Coupler (1) of 1.1 times mol was used instead of cyan coupler ExC in the fifth layer, and image-dye stabilizer Cpd-7 was excluded. Further, color print paper Sample 303 was prepared in the same manner as Sample 302, except that cyan coupler B in Example 1 of equimolar amount was used instead of Exemplified Coupler (1).

Samples of color print paper prepared as described above were subjected to the following processing.

First, each of samples was subjected to a gradation exposure to light through three color separated filter for sensitometry using a sensitometer (FWH model made by Fuji Photo Film Co., Ltd., the color temperature of light source was 3200 K.). At that time, the exposure was carried out in such a manner that the exposure amount was 250 CMS with the exposure time being 0.1 sec.

After exposure to light, each sample was subjected to a continuous processing (running test) according to the following processing process and processing solutions using a paper processor, until the replenishing amount of color developer reached to two times tank volume.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse 1 | 30–35° C. | 20 sec | — | 10 liter |
| Rinse 2 | 30–35° C. | 20 sec | — | 10 liter |
| Rinse 3 | 30–35° C. | 20 sec | 350 ml | 10 liter |
| Drying | 70–80° C. | 60 sec | | |

Note:
*Replenisher amount per $m^2$ of photographic material.
Rinsing steps were carried out in 3-tanks countercurrent mode from the tank of rinse 3 toward the tank of rinse 1.

The composition of each processing solution is as followed, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |

| Bleach-fixing solution (Both tank solution and replenisher) | |
|---|---|
| Water | 400 ml |
| Ammonium thiosulfate (700 g/l) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Water to make | 1000 ml |
| pH (25°) | 6.0 |

| Rinse solution (Both tank solution and replenisher) |
|---|
| Ion-exchanged water (calcium and magnesium each are 3 ppm or below) |

After Samples 301 to 303 of color print paper were subjected to the above-described processing, the reflection spectrum of each color image obtained was measured. Further, Samples were kept in a condition of 80° C. and 70% RH for one day, as same as in Example 1, and again the reflection spectrum was measured.

As a result, although Sample 303 was large in changes of hue and image dye density, Samples 301 and 302 had no changes in hue and image dye, thereby being confirmed that the effect obtained in Example 1 can be also attained in a multilayer color photosensitive material.

Further, when color print paper Samples 301 and 302 were compared each other, it was confirmed that Sample 302 was excellent in color reproduction of yellow to green.

EXAMPLE 4

A multilayer color photographic material sample 101 was prepared by multi-coating each layer having a composition as shown below on a prime-coated triacetate cellulose film support having a thickness of 127 μm, which was named ample 401. Figures corresponding to each component represent added amounts per $m^2$. Effects of compound added are not restricted to usage described.

Then, Sample 402 was prepared by changing preparing conditions of Sample 401 as follows:

Fourth layer: Emulsions A and B added were reduced to 70%, and couplers C-1 to C-3 and C-9 were exchanged with cyan coupler 1 of the present invention in equimolar amount.

Fifth and Sixth layers: Added amounts of emulsions were reduced to 65%, and couplers C-1 to C-3 were exchanged with cyan coupler 1 of the present invention.

Further, Sample 403 was prepared in the same manner as Sample 402, except that Coupler B of Example 1 was used instead of cyan coupler 1.

| (Composition of photosensitive layer) | |
|---|---|
| First layer: Halation preventing layer | |
| Black colloidal silver | 0.20 g |
| Gelatin | 1.9 g |
| UV absorbent U-1 | 0.1 g |
| UV absorbent U-3 | 0.04 g |
| UV absorbent U-4 | 0.1 g |
| High-boiling organic solvent Oil-1 | 0.1 g |
| Dispersion of fine solid crystal of dye E-1 | 0.1 g |
| Second layer: Intermediate-layer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-1 | 0.4 mg |
| Third layer: Intermediate layer | |
| Fine grain silver iodobromide emulsion that had been fogged surface and inner side (av. grain diameter: 0.06 μm, deviation coefficient: 18%, AgI content: 1 mol %, and the remainder was AgBr) | silver 0.05 g |
| Gelatin | 0.4 g |
| Fourth layer: Low sensitivity red-sensitive emulsion layer) | |
| Emulsion A | silver 0.1 g |
| Emulsion B | silver 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Fifth layer: Medium sensitivity red-sensitive emulsion layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Sixth layer: High sensitivity red-sensitive emulsion layer | |
| Emulsion D | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix inhibitor Cpd-1 | 2.6 mg |
| UV absorbent U-1 | 0.01 g |
| UV absorbent U-2 | 0.002 g |

-continued

| (Composition of photosensitive layer) | |
|---|---|
| UV absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-3 | 0.02 g |
| Eighth layer: Intermediate layer | |
| Fine grain silver iodobromide emulsion that had been fogged surface and inner side (av. grain diameter: 0.06 μm, deviation coefficient: 16%, AgI content: 0.3 mol %, and the remainder was AgBr) | silver 0.02 g |
| Gelatin | 1.0 g |
| Additive P-1 | 0.2 g |
| Color-mix inhibitor Cpd-A | 0.1 g |
| Ninth layer: Low sensitivity green-sensitive emulsion layer) | |
| Emulsion E | silver 0.1 g |
| Emulsion F | silver 0.2 g |
| Emulsion G | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion G | silver 0.3 g |
| Emulsion H | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Eleventh layer: High sensitivity green-sensitive emulsion layer | |
| Emulsion I | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Thirteenth layer: Yellow filter layer | |
| Yellow colloidal silver | silver 0.07 g |
| Gelatin | 1.1 g |

-continued

| (Composition of photosensitive layer) | |
|---|---|
| Color-mix inhibitor Cpd-A | 0.01 g |
| High-boiling organic solvent Oil-1 | 0.01 g |
| Dispersion of fine solid crystal of dye E-2 | 0.05 g |
| Fourteenth layer: Intermediate layer | |
| Gelatin | 0.6 g |
| Fifteenth layer: Low sensitivity blue-sensitive emulsion layer | |
| Emulsion J | silver 0.2 g |
| Emulsion K | silver 0.3 g |
| Emulsion L | silver 0.1 g |
| Gelatin | 0.8 g |
| Coupler C-5 | 0.2 g |
| Coupler C-6 | 0.1 g |
| Coupler C-10 | 0.4 g |
| Sixteenth layer: Medium sensitivity blue-sensitive emulsion layer | |
| Emulsion L | silver 0.1 g |
| Emulsion M | silver 0.4 g |
| Gelatin | 0.8 g |
| Coupler C-5 | 0.3 g |
| Coupler C-6 | 0.1 g |
| Coupler C-10 | 0.1 g |
| Seventeenth layer: High sensitivity blue-sensitive emulsion layer | |
| Emulsion N | silver 0.4 g |
| Gelatin | 1.2 g |
| Coupler C-5 | 0.3 g |
| Coupler C-6 | 0.6 g |
| Coupler C-10 | 0.1 g |
| Eighteenth layer: First protective layer | |
| Gelatin | 0.7 g |
| UV absorbent U-1 | 0.2 g |
| UV absorbent U-2 | 0.05 g |
| UV absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer: Second protective layer | |
| Colloidal silver | silver 0.1 mg |
| Fine grain silver iodobromide emulsion (av. grain diameter: 0.06 μm, AgI content: 1 mol %) | silver 0.1 g |
| Gelatin | 0.4 g |
| Twentieth layer: Third protective layer | |
| Gelatin | 0.4 g |
| Poly(methyl methacrylate) (av. diameter: 1.5 μm) | 0.1 g |
| Copolymer of methyl methacrylate and acrylic acid in a ratio of 4:6 (av. diameter: 1.5 μm) | 0.1 g |
| Silicone oil | 0.03 g |
| Surface-active agent W-1 | 3.0 mg |
| Surface-active agent W-2 | 0.03 g |

Further, besides above-mentioned components, additives F-1 to F-8 were added in all emulsion layers. Further, besides above-mentioned component, gelatin hardener H-1 and surface-active agents W-3, W-4, W-5, and W-6 were added in each layer.

Further, as antiseptics and antimolds, phenol, 1,2-benzisothiazoline-3-one, 2-phenoxyethanol, and phenethyl alcohol were added.

Details of silver iodobromide emulsions which were used in Sample 401 are as shown in the following Tables 2 and 3.

TABLE 2

| Emulsion | Features of grains | Av. grain diameter (μm)* | Deviation coefficient (%) | AgI content (%) |
|---|---|---|---|---|
| A | Monodisperse emulsion, tetradecahedral grains | 0.28 | 16 | 3.7 |
| B | Monodisperse emulsion, cubic grains, inner latent image-type | 0.30 | 10 | 3.3 |
| C | Monodisperse emulsion, tabular grains, av. aspect ratio: 4.0 | 0.38 | 18 | 5.0 |
| D | Tabular grains, av. aspect ratio: 8.0 | 0.68 | 25 | 2.0 |

TABLE 2-continued

| Emulsion | Features of grains | Av. grain diameter (μm)* | Deviation coefficient (%) | AgI content (%) |
|---|---|---|---|---|
| E | Monodisperse emulsion, cubic grains | 0.20 | 17 | 4.0 |
| F | Monodisperse emulsion, cubic grains | 0.23 | 16 | 4.0 |
| G | Monodisperse emulsion, cubic grains, inner latent image-type | 0.28 | 11 | 3.5 |
| H | Monodisperse emulsion, cubic grains, inner latent image-type | 0.32 | 9 | 3.5 |
| I | Tabular grains, av. aspect ratio: 9.0 | 0.80 | 28 | 1.5 |
| J | Monodisperse emulsion, tetradecahedral grains | 0.30 | 18 | 4.0 |
| K | Monodisperse emulsion, tabular grains, av. aspect ratio: 7.0 | 0.45 | 17 | 4.0 |
| L | Monodisperse emulsion, cubic grains, inner latent image-type | 0.46 | 14 | 3.5 |
| M | Monodisperse emulsion, tabular grains, av. aspect ratio: 10.0 | 0.55 | 13 | 4.0 |
| N | Tabular grains, av. aspect ratio: 12.0 | 1.00 | 33 | 1.3 |

Note;
*Average grain diameter corresponding to sphere

TABLE 3

| Emulsion | Spectral sensitization of emulsions A to N: Sensitizing dye added | Amount added per mol of silver halide (g) |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |
| | S-7 | 0.01 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |

TABLE 3-continued

| Emulsion | Spectral sensitization of emulsions A to N: Sensitizing dye added | Amount added per mol of silver halide (g) |
|---|---|---|
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

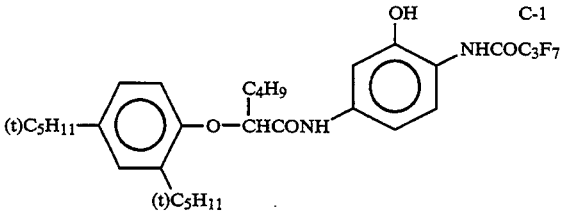

C-1

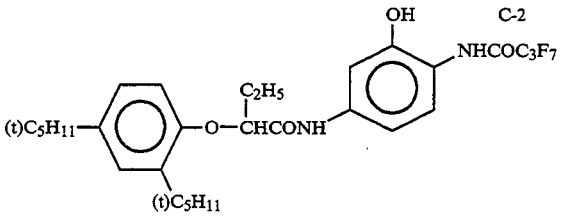

C-2

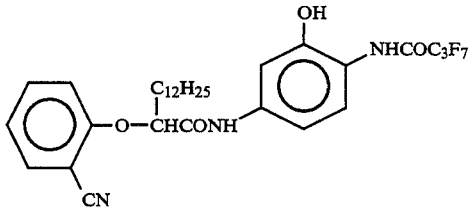

C-3

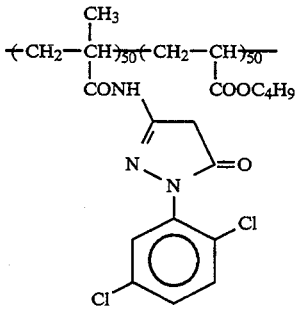

C-4

FIGS. show weight %.
av. molecular weight:
ca. 25,000

-continued
C-5
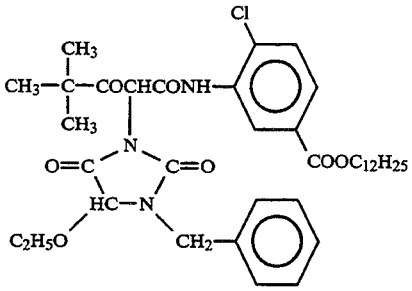
C-6
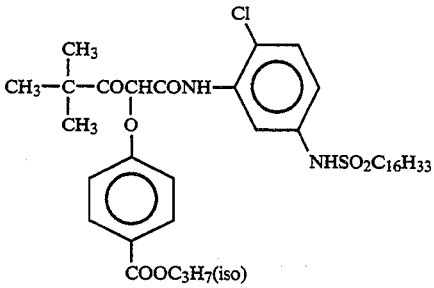
C-7
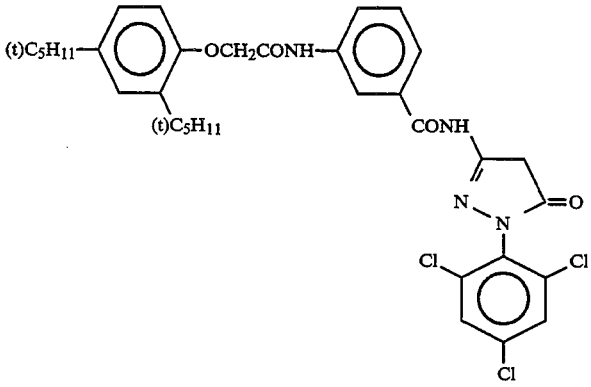
C-8
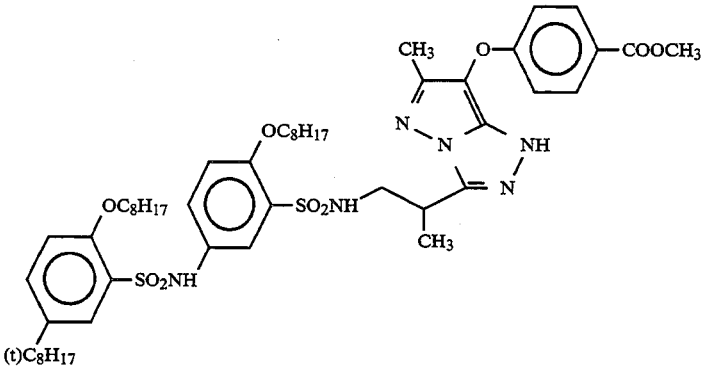
C-9
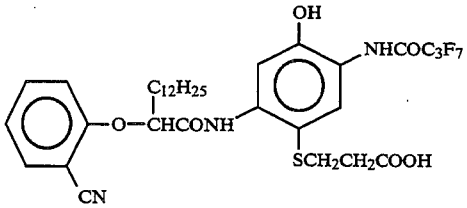
C-10
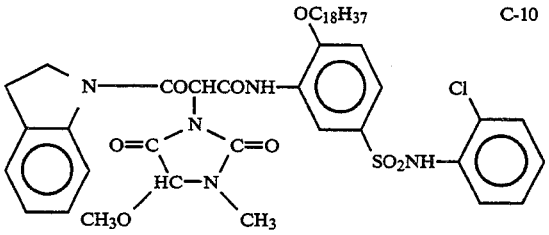
Dibutyl phthalate Oil-1
Tricresyl phosphate Oil-2
Oil-3
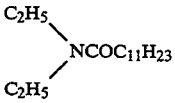
Cpd-A
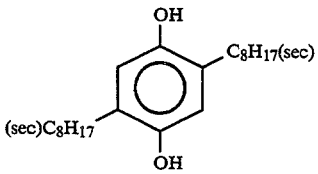

-continued
Cpd-B
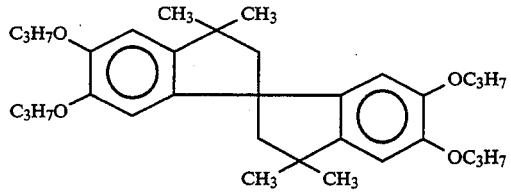
Cpd-C
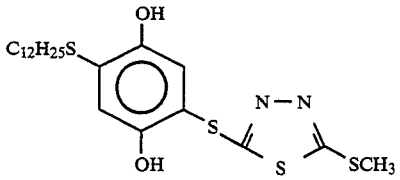
Cpd-D
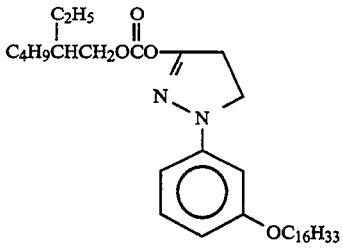
Cpd-E
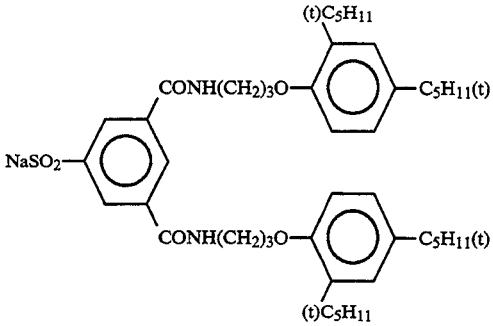
Cpd-F
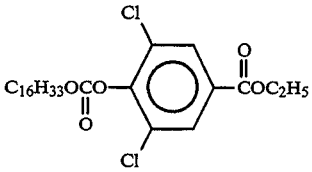
Cpd-G
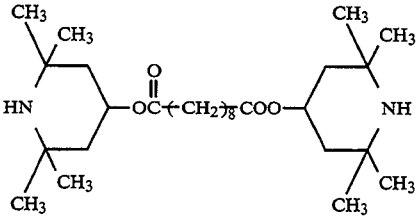
Cpd-H
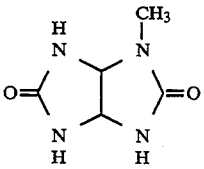
Cpd-I
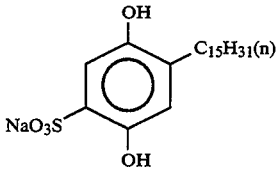
Cpd-J
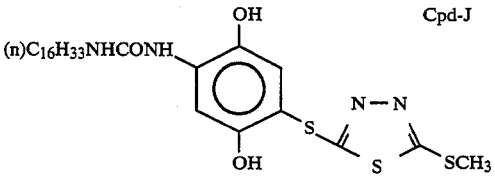
Cpd-K
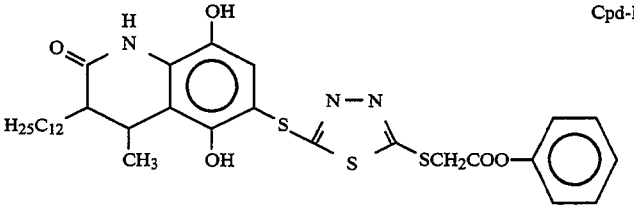
U-1
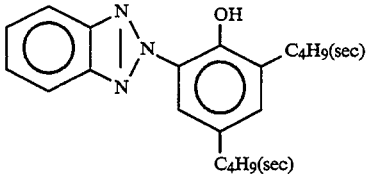
U-2
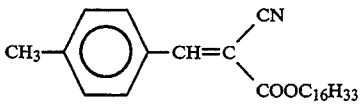
U-3
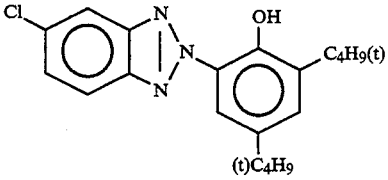
U-4
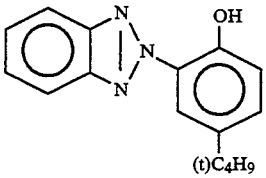
U-5
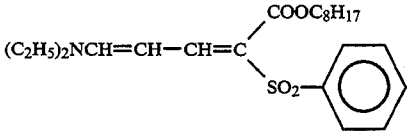
S-1
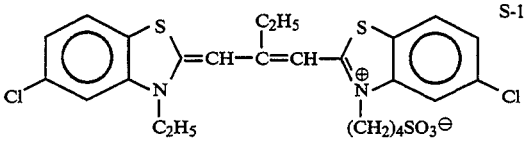

-continued
S-2
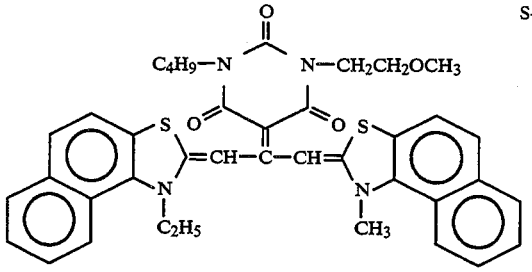
S-3
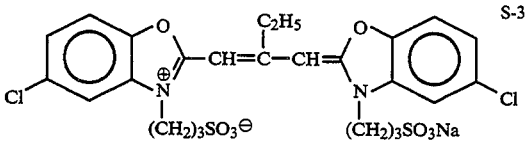
S-4
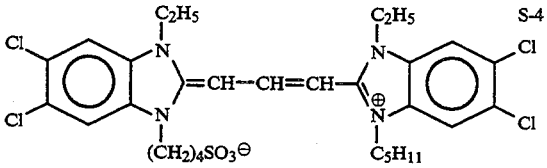
S-5
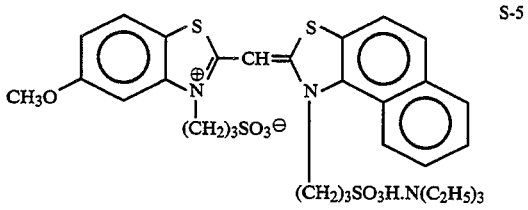
S-6
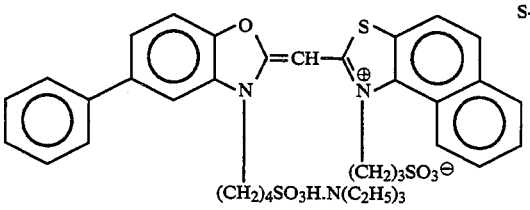
S-7
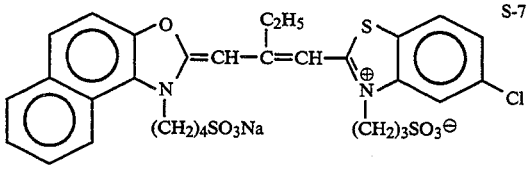
S-8
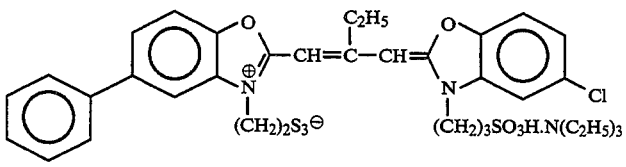
D-1
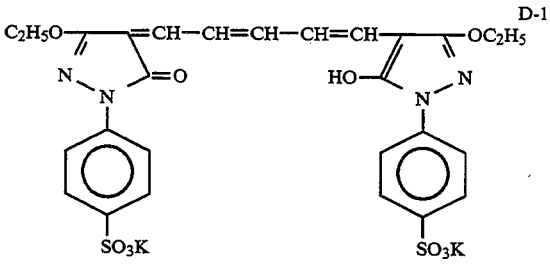
D-2
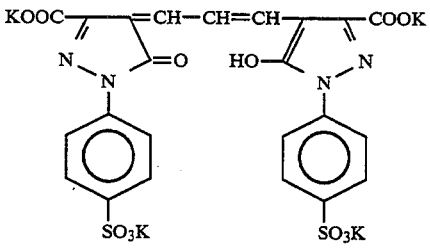
D-3
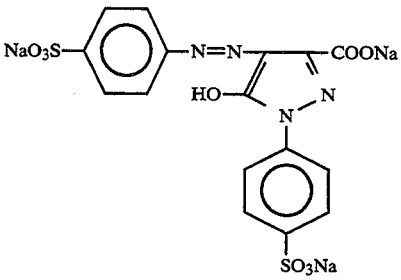
D-4
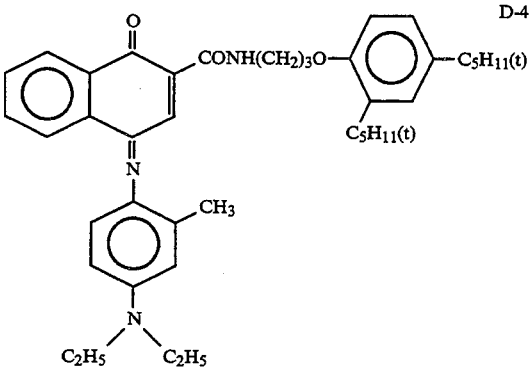

-continued
E-1
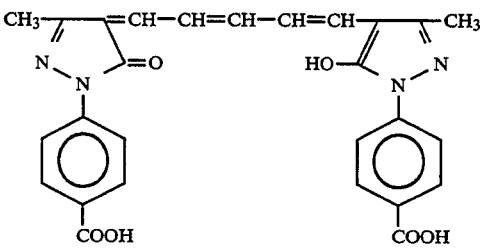
E-2
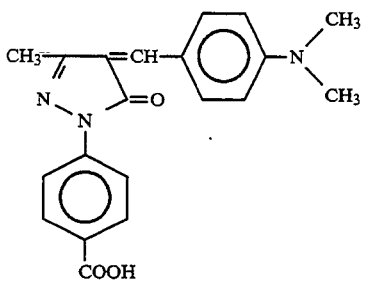
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
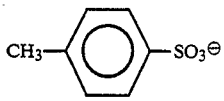
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
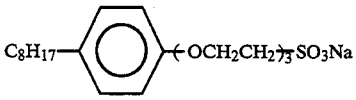
W-5
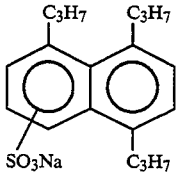
W-6
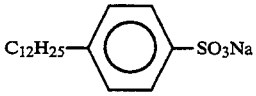
P-1
$\left(CH_2{-}CH(CONHC_4H_9(t))\right)_n$
M-1
$\left(CH_2{-}CH(COOC_4H_9)\right)_n$
F-1
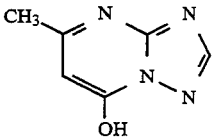
F-2
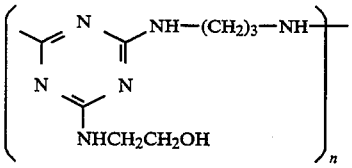
$\cdot HNO_3$
F-3
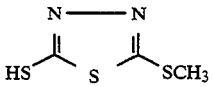
F-4
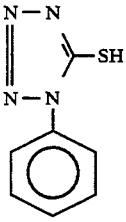
F-5
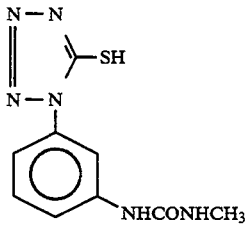
F-6
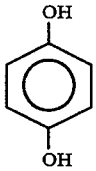
F-7
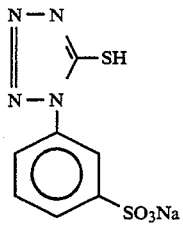

-continued

F-8

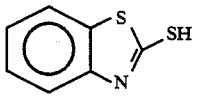

Thus-prepared silver halide color photographic materials were processed, after exposure to light, according to the following process.

| Processing process | Time | Temperature |
|---|---|---|
| First developing | 6 min | 38° C. |
| Water washing | 2 min | 38° C. |
| Reversal | 2 min | 38° C. |
| Color developing | 6 min | 38° C. |
| Conditioning | 2 min | 38° C. |
| Bleaching | 6 min | 38° C. |
| Fixing | 4 min | 38° C. |
| Water washing | 4 min | 38° C. |
| Stabilizing | 1 min | 25° C. |

The compositions of the respective processing solution were as follows:

| | |
|---|---|
| (First developer) | |
| Pentasodium nitorilo-N,N,N-trimethylene-phosphonate | 1.5 g |
| Pentasodium diethylenetriaminepentaacetate | 2.0 g |
| Sodium sulfite | 30 g |
| HydroquinoneNpotassium monosulfonate | 20 g |
| Potassium carbonate | 15 g |
| Sodium bicarbonate | 12 g |
| 1-Phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Water to make | 1,000 ml |
| pH | 9.60 |
| (pH was adjusted by hydrochloric acid or potassium hydroxide.) | |
| (Reversal solution) | |
| Pentasodium nitrilo-N,N,N-trimethylene phophonate | 3.0 g |
| Stannus chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |
| (pH was adjusted by hydrochloric acid or potassium hydroxide.) | |
| (Color developer) | |
| Pentasodium nitorilo-N,N,N-trimethylene phosphonate | 2.0 g |
| Sodium sulfite | 7.0 g |
| Trisodium phosphate $12H_2O$ | 36 g |
| Potassium bromide | 1.0 g |
| Potassium iodide | 90 mg |
| Sodium hydroxide | 3.0 g |
| Ditradinic acid | 1.5 g |
| N-Ethyl-N-(β-methanesufonamidoethyl)-3-methylanilineN3/2sulfate monohydrate | 11 g |
| 3,6-dithiaoctane-1,8-diol | 1.0 g |
| Water to make | 1,000 ml |
| pH | 11.80 |
| (pH was adjusted by hydrochloric acid or potassium hydroxide.) | |
| (Conditioner) | |
| Disodium ethylenediaminetetraacetate dihydrate | 8.0 g |
| Sodium sulfite | 12 g |
| 1-Thioglycerol | 0.4 g |
| Adduct of formalinNsodium bisulfite | 30 g |

-continued

| | |
|---|---|
| Water to make | 1,000 ml |
| pH | 6.20 |
| (pH was adjusted by hydrochloric acid or potassium hydroxide.) | |
| (Bleaching solution) | |
| Disodium ethylenediaminetetraacetate dihydrate | 2.0 g |
| Iron (III) ammonium ethylenediamine-tetraacetate dihydrate | 120 g |
| Potassium bromide | 100 g |
| Ammonium nitrate | 10 g |
| Water to make | 1,000 ml |
| pH | 6.20 |
| (pH was adjusted by hydrochloric acid or potassium hydroxide.) | |
| (Fixing solution) | |
| Ammonium thiosulfate | 80 g |
| Sodium sulfite | 5.0 g |
| Sodium bisulfite | 5.0 g |
| Water to make | 1.000 ml |
| pH | 6.5 |
| (pH was adjusted by hydrochloric acid or aqueous ammonia.) | |
| (Stabilizing solution) | |
| Benzoisothiazoline-3-one | 0.02 g |
| Polyoxyethylene-p-monononyl phenylether (av. polymerization degree: 10) | 0.3 g |
| Water to make | 1,000 ml |
| pH | 6.5 |

Spectrum of image dye obtained by a mono-color exposure to light of Samples 401 to 403 and spectrum after storage were measured in the same manner as in Example 1. As a result, it was found that the cyan coupler of the present invention has a good color reproduction property and is excellent in stabilities of hue and color density.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material, which comprises at least one cyan dye-forming coupler represented by formula (I): formula (I)

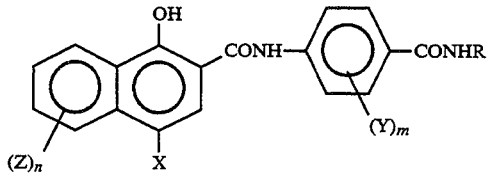

wherein R represents a hydrogen atom, Y represents a group capable of substitution onto a benzene ring, Z represents a group capable of substitution onto a naphthalene ring, X represents a hydrogen atom or a coupling-off group capable of being released upon a coupling reaction with the oxidized product of an aromatic primary amine developing agent and selected from the group consisting of a halogen atom, a sulfo group, a thiocyanato group, an alkoxy group having a C-number of 1 to 40, an aryloxy group having a C-number of 6 to 40, an alkylthio group having a C-number of 1 to 40, an arylthio group having a C-number of 6 to 50, an alkylsulfonyl group having a C-number of 1 to 40, an arylsulfonyll group having a C-number of 6 to 50, a heterocyclic oxy group having a C-number of 2 to 46, a heterocyclic thio group having a C-number of 2 to 46, an acyloxy group having a C-number of 1 to 40, a carbamoyloxy group having a C-number of 2 to 40, an azolyl group having a C-number of 1 to 50, an imido group having a C-number of 4 to 50, and a hydantoinyl group having a C-number of 3 to 50, m is an integer of 0 to 4, and n is an integer of 0 to 4.

2. The silver halide color photographic material as claimed in claim 1, wherein Z and Y in formula (I) each represent a halogen atom, an alkyl group, an alkoxy group, an acyl group, a carbonamido group, a sulfonamido group, a carbamoyl group, a sulfamoyl group, or a cyano group.

3. The silver halide color photographic material as claimed in claim 1, wherein n in formula (I) is 0.

4. A silver halide color photographic material, which comprises at least one cyan dye-forming coupler represented by formula (I) which is dispersed in an organic solvent containing at least one solvent selected from the group consisting of phthalates, aliphatic esters, phosphates, and chlorinated paraffins: formula (I)

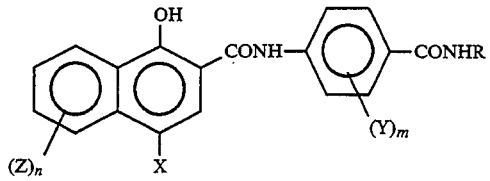

wherein R represents a hydrogen atom, Y represents a group capable of substitution onto a benzene ring, Z represents a group capable of substitution onto a naphthalene ring, X represents a hydrogen atom or a coupling-off group capable of being released upon a coupling reaction with the oxidized product of an aromatic primary amine developing agent and selected from the group consisting of a halogen atom, a sulfo group, a thiocyanato group, an alkoxy group having a C-number of 1 to 40, an aryloxy group having a C-number of 6 to 40, an alkylthio group having a C-number of 1 to 40, an arylthio group having a C-number of 6 to 50, an alkylsulfonyl group having a C-number of 1 to 40, an arylsulfonyl group having a C-number of 6 to 50, a heterocyclic oxy group having a C-number of 2 to 46, a heterocyclic thio group having a C-number of 2 to 46, an acyloxy group having a C-number of 1 to 40, a carbamoyloxy group having a C-number of 2 to 40, an azolyl group having a C-number of 1 to 50, an imido group having a C-number of 4 to 50, and a hydantoinyl group having a C-number of 3 to 50, m is an integer of 0 to 4, and n is an integer of 0 to 4.

5. The silver halide color photographic material as claimed in claim 4, wherein the dielectric constant at 25° C. of the organic solvent is 2 to 20.

6. The silver halide color photographic material as claimed in claim 4, wherein the dielectric constant at 25° C. of the organic solvent is 2 to 10.

7. The silver halide color photographic material as claimed in claim 4, wherein the organic solvent is used in an weight ratio to the coupler of 0 to 2.0.

8. The silver halide color photographic material as claimed in claim 4, wherein the organic solvent is used in an weight ratio to the coupler of 0 to 1.0.

* * * * *